US012220090B2

(12) United States Patent
Huang

(10) Patent No.: US 12,220,090 B2
(45) **Date of Patent: *Feb. 11, 2025**

(54) FABRIC TOWEL DISPENSER WITH TOWEL REPLACEMENT ARRANGEMENT

(71) Applicant: Wei Huang, Irvine, CA (US)

(72) Inventor: Wei Huang, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/443,264

(22) Filed: Feb. 15, 2024

(65) Prior Publication Data

US 2024/0366040 A1 Nov. 7, 2024

Related U.S. Application Data

(63) Continuation of application No. 18/553,731, filed as application No. PCT/US2023/066515 on May 2, 2023.

(51) Int. Cl.
*A47K 10/28* (2006.01)

(52) U.S. Cl.
CPC ..... *A47K 10/28* (2013.01)

(58) Field of Classification Search
CPC ..... A47K 10/28
USPC ..... 34/90; 226/127
See application file for complete search history.

(56) References Cited

U.S. PATENT DOCUMENTS 1,746,582 A * 2/1930 Elder ..... B65H 35/0006 226/176
2,560,061 A * 7/1951 Agamaite, Jr. ..... A47K 10/38 83/345
3,288,387 A * 11/1966 Craven, Jr. ..... A47K 10/3687 242/560.1
4,245,413 A * 1/1981 Oberhoff ..... A47K 10/30 68/92
5,604,992 A * 2/1997 Robinson ..... A47K 10/485 242/560
6,128,826 A * 10/2000 Robinson ..... A47K 10/485 34/90
6,161,795 A * 12/2000 Skerrett ..... A47K 10/36 242/595.1
9,125,533 B2 * 9/2015 Babikian ..... A47K 10/485
11,179,010 B2 * 11/2021 Sexton ..... A47K 10/3612
(Continued)

FOREIGN PATENT DOCUMENTS

CN 110072417 A * 7/2019 ..... A47K 10/32
WO WO-2018126236 A1 * 7/2018 ..... A47K 10/32

*Primary Examiner* — Stephen M Gravini
(74) *Attorney, Agent, or Firm* — Tsz Lung Yeung

(57) ABSTRACT

A fabric towel dispenser includes a main housing having a receiving compartment, a used towel supporting shaft, a dispensing roller, a driving assembly, a plurality of guiding members, and a towel replacement arrangement. The used towel supporting shaft extends perpendicularly from the wall surface on which the main housing is mounted for supporting a used towel roll. The towel replacement arrangement includes a supporting panel which is capable of operating between a locking mode and a releasing mode, wherein in the locking mode, the supporting panel is securely connected to the used towel supporting shaft to lock up a position of the used towel supporting shaft in the receiving compartment, wherein in the releasing mode, the supporting panel is arranged to unlock the used towel supporting shaft for facilitating disposal of the used towel sheet.

19 Claims, 16 Drawing Sheets

(56) References Cited

U.S. PATENT DOCUMENTS

| | | | | |
|---|---|---|---|---|
| 11,454,056 | B2 * | 9/2022 | Paré | A47K 10/32 |
| 11,723,495 | B2 * | 8/2023 | Lewis | A47K 10/36<br>242/560 |
| 11,937,740 | B1 * | 3/2024 | Huang | A47K 10/28 |

* cited by examiner

FABRIC TOWEL DISPENSER WITH TOWEL REPLACEMENT ARRANGEMENT

CROSS REFERENCES OF RELATED APPLICATIONS

This is a Continuation application of a non-provisional application having an application number of Ser. No. 18/553,731, and a filing date of Oct. 2, 2023, which is a 371 of International application number PCT/US2023/066515, filing date May 2, 2023. These applications are incorporated by reference herein.

BACKGROUND OF THE PRESENT INVENTION

Field of Invention

The present invention relates to a fabric towel dispenser, and more particularly to a fabric towel dispenser comprising a towel replacement arrangement which is capable of facilitating rapid and convenient retrieval and disposal of used and unused towel sheet while saving space and making the unit compact enough.

Description of Related Arts

A conventional fabric towel dispenser for dispensing a towel loop usually comprises a housing having a dispensing slot, and a plurality of rollers mounted in the housing for driving a towel sheet to move through the dispensing slot. The towel sheet is configured as a roll and is operatively supported by the rollers. The rollers are driven to rotate and the towel sheet is driven to move accordingly until a portion of the towel sheet has passed through the dispensing slot and exposed out of the housing. A user may then use the exposed portion of the towel sheet to absorb moisture from his or her hands. After that, the rollers are driven to rotate again to retract the used portion of the towel sheet and dispense an unused portion of the towel sheet through the dispensing slot for next user. Used towel sheet will then be continuously retracted and rolled in the housing for eventual disposal.

A major disadvantage of the above-mentioned conventional fabric towel dispenser is that it is relatively inconvenient to open the housing and replace the used towel sheet with an unused towel sheet. Moreover, almost all conventional fabric towel dispensers utilize rollers which are substantially parallel to the wall on which on the housing is mounted. This is ergonomically undesirable and causes the housing to occupy too much space in the bathroom and make the replacement of towel sheet inconvenient.

As a result, there is a need to develop a fabric towel dispenser which is capable of facilitating rapid and convenient retrieval and disposal of used towel sheet, and replacement of new towel sheet in an ergonomically desirable manner

SUMMARY OF THE PRESENT INVENTION

Certain variations of the present invention provide a fabric towel dispenser comprising a towel replacement arrangement which is capable of facilitating rapid and convenient retrieval and disposal of used and new towel sheet in an ergonomically desirable manner.

Certain variations of the present invention provide a fabric towel dispenser comprising a towel replacement arrangement which is configured to save bathroom space while allowing rapid and convenient replacement of used towel sheet with new unused towel sheet.

In one aspect of the present invention, it provides a fabric towel dispenser mounted on a wall surface, comprising:

- a fabric towel dispenser mounted on a wall surface, comprising:
- a main housing mounted on the wall surface and having a receiving compartment, and a dispensing opening which is substantially vertical to the wall surface communicating with the receiving compartment, the receiving compartment being adapted for receiving a roll of unused towel sheet which is substantially vertical to the wall surface;
- a used towel supporting shaft extending perpendicular to the wall surface and being detachably or rigidly mounted in the main housing for supporting a roll of used towel sheet;
- a dispensing roller supported in the main housing for driving the unused towel sheet to be dispensed out of the dispensing opening;
- a driving assembly mounted in the receiving compartment and connected to the used towel supporting shaft and the dispensing roller for sequentially driving the unused towel sheet to pass through the dispensing opening for dispensing, and to drive the used towel sheet be retracted and collected by the used towel supporting shaft;
- a plurality of guiding members mounted in the receiving compartment for guiding the roll of unused towel sheet to sequentially pass through the dispensing opening and collected by the used towel supporting shaft; and
- a towel replacement arrangement which comprises a supporting panel which is supported in the receiving compartment, and connected to the used towel supporting shaft, in such a manner that the supporting panel is capable of operating between a locking mode and a releasing mode, wherein in the locking mode, the supporting panel is securely connected to the used towel supporting shaft to lock up a position of the used towel supporting shaft in the receiving compartment, wherein in the releasing mode, the supporting panel is arranged to unlock the used towel supporting shaft for facilitating disposal of the used towel sheet.

This summary presented above is provided merely to introduce certain concepts and not to identify any key or essential features of the claimed subject matter.

DETAILED DESCRIPTION OF THE PREFERRED EMBODIMENT

Figure 1:
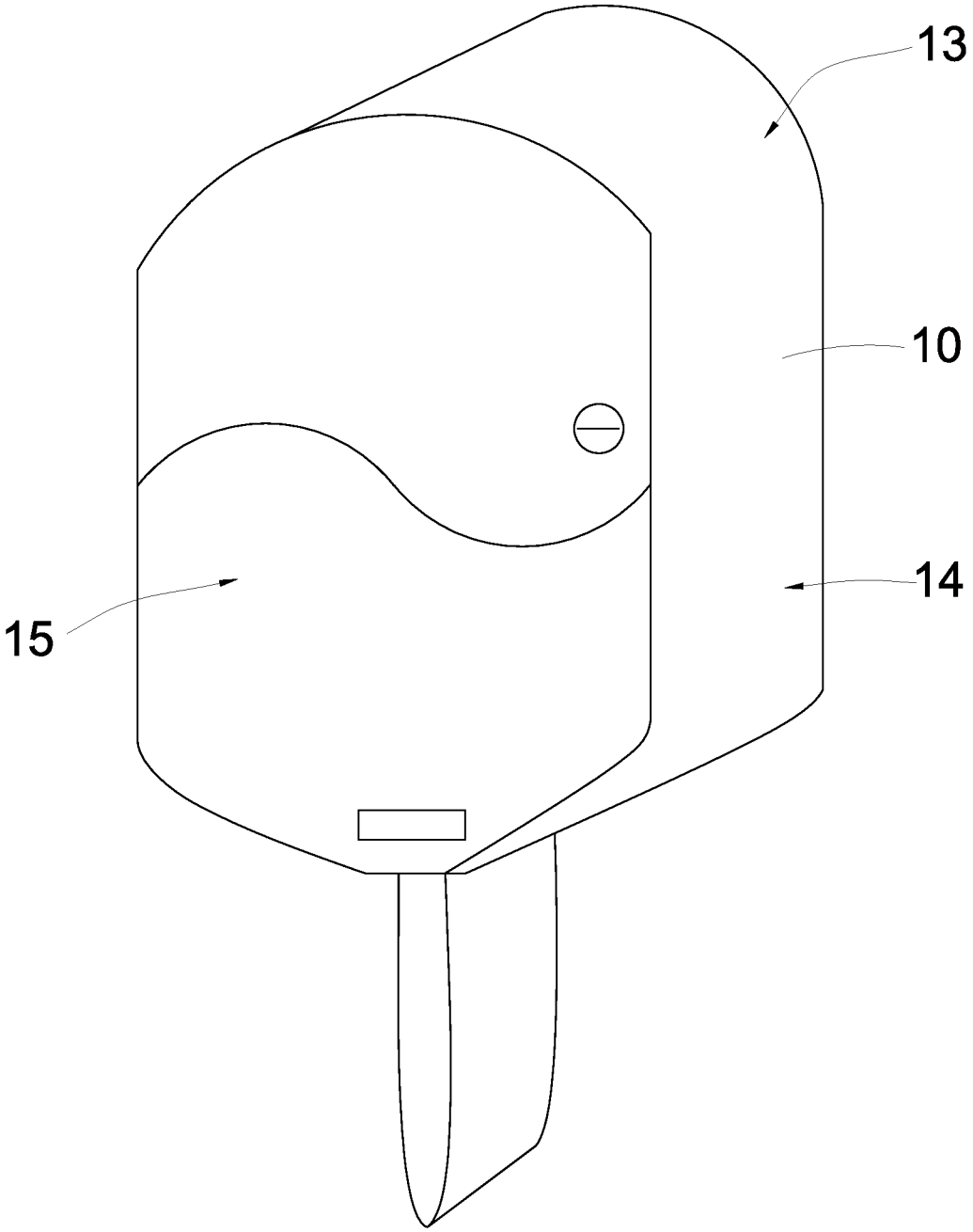
FIG. 1 is a perspective view of a fabric towel dispenser according to a preferred embodiment of the present invention.

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Referring to FIG. 1 to FIG. 6 of the drawings, a fabric towel dispenser according to a preferred embodiment of the present invention is illustrated. Broadly, the fabric towel dispenser may comprise a main housing 10 having a dispensing opening 12, a used towel supporting shaft 20, a dispenser roller 30, a driving assembly 40, a plurality of guiding members 50, and a towel replacement arrangement 60. The fabric towel dispenser may be configured for use with a towel sheet 100 used for absorbing moisture from a user's hand. The fabric towel dispenser of the present invention may be mounted on a wall surface which is substantially vertical. This is a typical environment in which the present invention is to be utilized.

The towel sheet 100 may be a sheet of paper towel or a sheet of fabric towel. The towel sheet 100 may be configured to form a roll so that it may be received in the main housing 10. The towel sheet 100 may be divided into an unused portion (unused towel sheet) and a used portion (used towel sheet). Initially, the entire roll of the towel sheet 100 is unused. The roll of unused towel sheet 100 (hereinafter identified as "unused towel roll 101") may be continuously driven to first pass through the dispensing opening 12 for absorbing moisture. After absorbing moisture, the unused portion of the towel sheet 100 may become used portion. The used portion may then be retracted and eventually supported and rolled by the used towel supporting shaft 20 to become a roll of used towel sheet 100 (hereinafter referred to as "used towel roll 102"). Thus, when more used towel sheet 100 is retracted and collected, a diameter or size of the used towel roll 102 may gradually increase while a diameter or size of the unused towel roll 101 may gradually decrease.

The main housing 10 may be mounted on the wall surface and may have a receiving compartment 11, and the dispensing opening 12 communicating the receiving compartment 11 with an exterior of the main housing 10. The receiving compartment 11 may be adapted for accommodating the unused or used towel roll and all other components of the present invention.

The used towel supporting shaft 20 may extend perpendicularly from the vertical wall surface and may be detachably mounted in the main housing 10 for supporting a roll of used towel sheet 100 (i.e. used towel roll 102).

The dispensing roller 30 may be supported in the main housing 10 for driving the unused towel sheet 100 to be dispensed out of the dispensing opening 12.

The driving assembly 40 may be mounted in the receiving compartment 11 and connected to the used towel supporting shaft 20 and the dispensing roller 30 for sequentially driving the unused towel sheet 100 to pass through the dispensing opening 11, and to be retracted and collected by the used towel supporting shaft 20.

A partitioning member 16 is provided in receiving compartment 11 at a position between roll of unused towel sheet 101 and used towel supporting shaft 20, it's arranged to move or/and be deformed in the receiving compartment corresponding to the change of the diameter of roll of the used towel sheet 101 and roll of unused towel sheet 102.

The plurality of guiding members 50 may be mounted in the receiving compartment 11 for guiding the roll of unused towel sheet 100 to pass through the dispensing opening 12 and eventually collected by the used towel supporting shaft 20.

The towel replacement arrangement 60 may comprise a supporting panel 61 which may be supported in the receiving compartment 11, and detachably connected to the used towel supporting shaft 20, in such a manner that the supporting panel 61 is capable of operating between a locking mode and a releasing mode, wherein in the locking mode, the supporting panel 61 is securely connected to the used towel supporting shaft 20 to lock up a position of the used towel supporting shaft 20 in the receiving compartment 11, wherein in the releasing mode, the supporting panel 61 may be arranged to unlock the used towel supporting shaft 20 for facilitating disposal of the used towel sheet 100.

Figure 2:
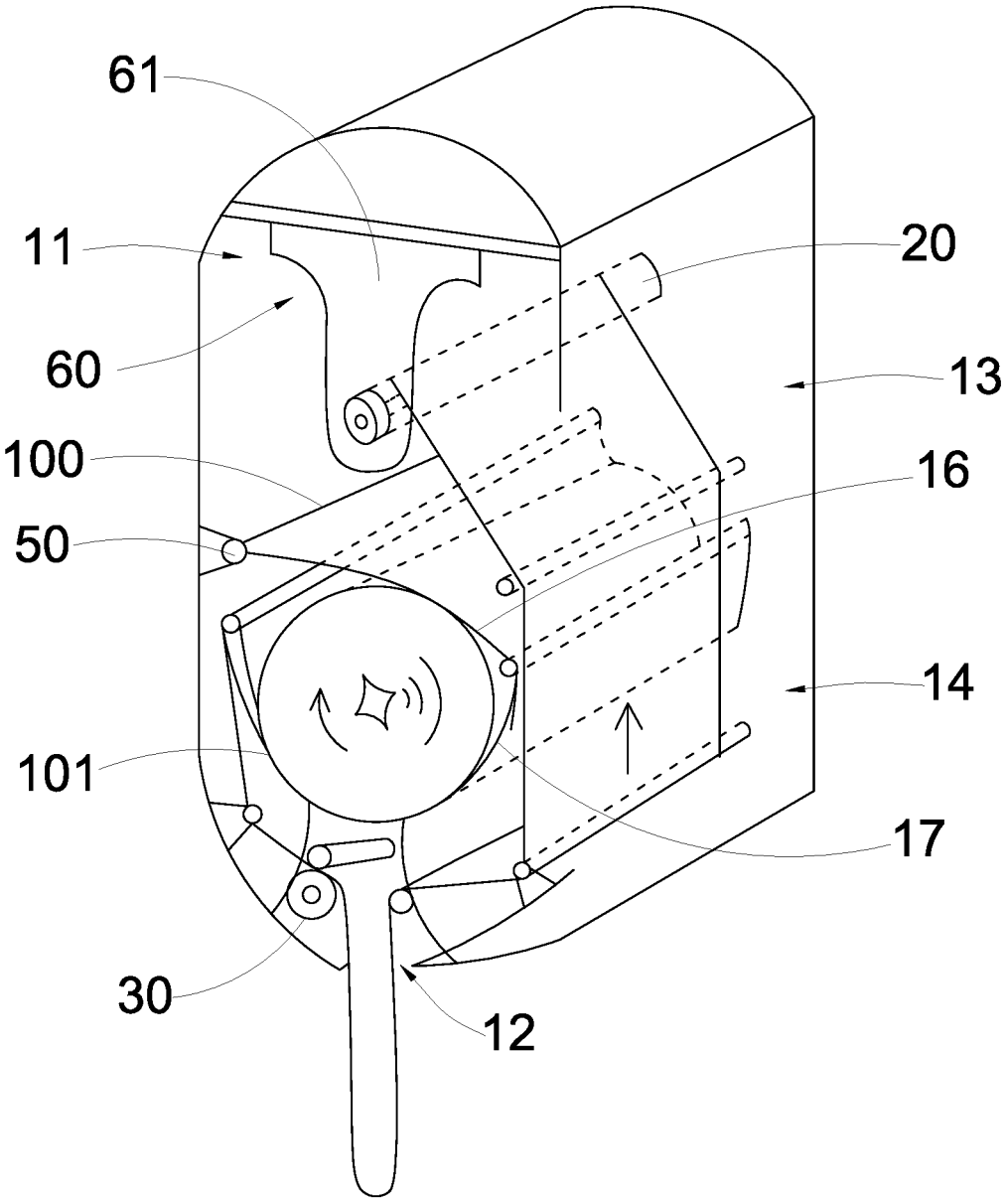
FIG. 2 is a perspective view of the fabric towel dispenser according to the preferred embodiment of the present invention, illustrating the internal structure of the fabric towel dispenser.
Figure 3:
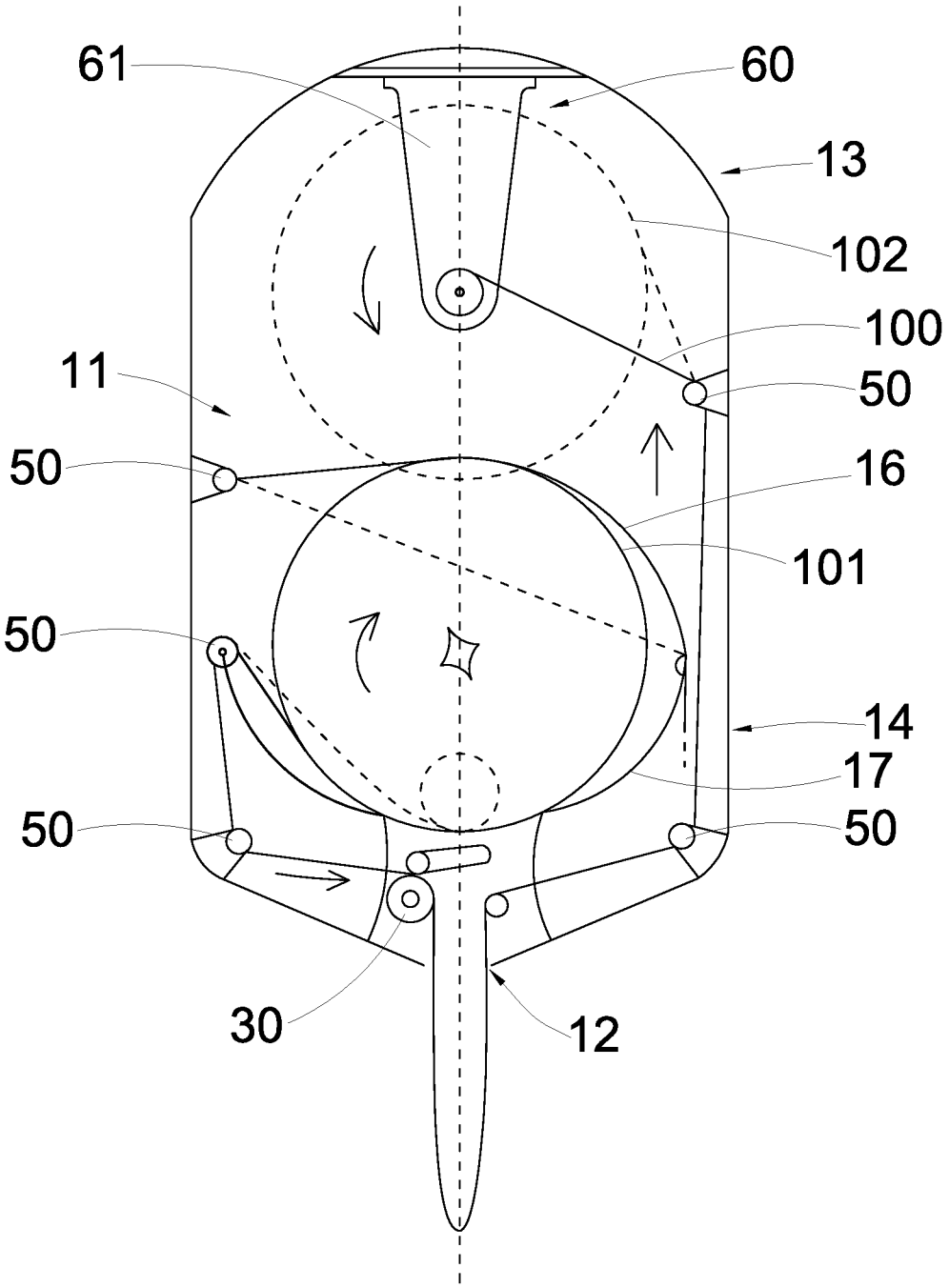
FIG. 3 is a front view of the fabric towel dispenser according to the preferred embodiment of the present invention.

According to the preferred embodiment of the present invention, the main housing 10 may be mounted on a vertical wall surface so that the used towel supporting shaft 20 may extend perpendicularly with respect to the wall surface and along the depth of the main housing 10. Referring to FIG. 1 and FIG. 2 of the drawings, the main housing 10 may be configured to have a generally elongated structure with respect to a vertical orientation. Thus, a vertical length of the main housing 10 may be substantially longer than a width thereof so as to form a rectangular cross-sectional shape when viewed from the front. Moreover, a depth of the main housing 10 may be determined such that the main housing 10 may accommodate the unused towel roll 101 in substantially horizontal orientation in which a longitudinal direction of the unused towel roll 101 may also extend perpendicularly with respect to the wall surface. Thus, the depth of the main housing 10 must be longer that a longitudinal length of the unused towel roll 101.

According to the preferred embodiment of the present invention, the main housing 10 may be divided into an upper portion 13 and a lower portion 14, wherein the unused towel roll 101 may be supported on a support groove 17 which is in the lower portion 14 of the main housing 10. Moreover, the main housing 10 may further comprise a front panel 15 which may be selectively opened to expose the receiving compartment 11 to ambient environment. A user may be able to open the front panel 15 and access the receiving compartment 11. The support groove 17 may be configured from rigid or deformable material such as metal or plastic, etc. The support groove 17 may have a curved contour.

The dispensing opening 12 may be formed at the lower portion 14 of the main housing 10 and preferably at a position adjacent to the unused towel roll 101. Thus, the unused portion of the towel sheet 100 may be arranged to first dispensed out of the main housing 10 through the dispensing opening 12, as shown in FIG. 2 of the drawings. The dispensed towel sheet 100 may form a towel loop which is disposed out of the main housing 10. The towel loop may be utilized for absorbing moisture from a user's hands.

Figure 4:
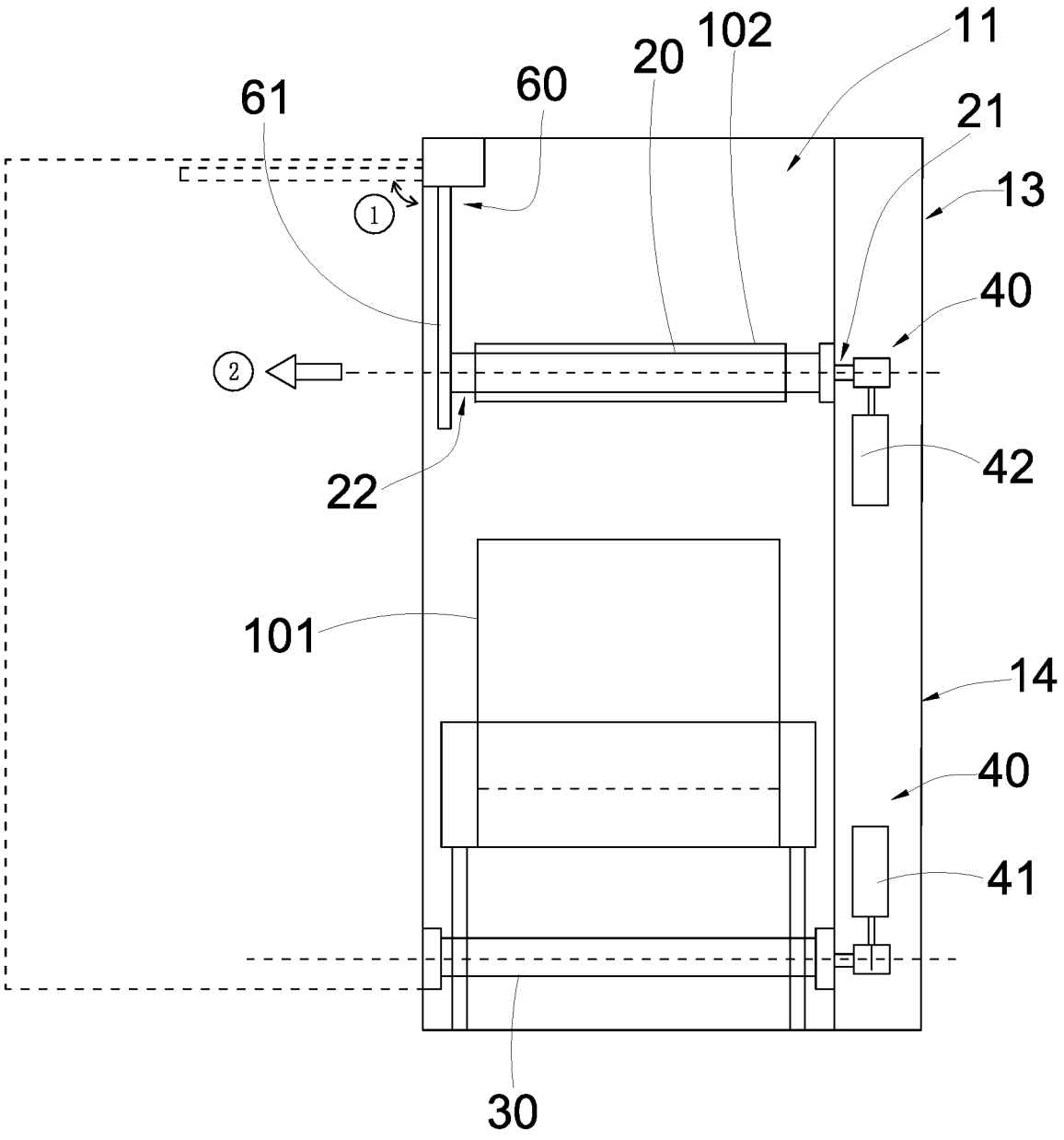
FIG. 4 is a side view of the fabric towel dispenser according to the preferred embodiment of the present invention.

The dispensing roller 30 may be mounted in the main housing 10 at a position adjacent to the dispensing opening 12. As shown in FIG. 4 of the drawings, the dispensing roller 30 may be configured as a shaft extending perpendicularly from the wall surface and along the depth of the main housing 10. Thus, the dispensing roller 30 may be substantially parallel to the used towel supporting shaft 20.

The driving assembly 40 may comprise a dispensing motor 41 mounted in the receiving compartment 11 and operatively connected to the dispensing roller 30. The dispensing motor 41 may be arranged to drive the dispensing roller 30 to rotate so as to drive the unused towel sheet 100 to be dispensed out of the main housing 10 through the dispensing opening 12.

The used towel supporting shaft 20 may be supported on the upper portion 13 of the main housing 10 in the receiving compartment 11. The used towel supporting shaft 20 may have a connecting end portion 21 and a locking end portion 22. In the preferred embodiment of the present invention, the used towel supporting shaft 20 may extend perpendicularly from the wall surface so that it is substantially parallel to the dispensing roller 30 as stated above.

The driving assembly 40 may further comprise a towel driving motor 42 mounted in the main housing 10 and operatively connected to the used towel supporting shaft 20 at the connecting end portion 21. The towel driving motor 42 may drive the used towel supporting shaft 20 to rotate, wherein the used towel supporting shaft 20 may be attached to the towel sheet 100 so that when the used towel supporting shaft 20 is driven to rotate, the towel sheet 100 is rolled thereon. The used towel supporting shaft 20 is utilized for retracting the used portion of the towel sheet 100 from the dispensing opening 12 to form the used towel roll 102. As shown in FIG. 4 of the drawings, the used towel supporting shaft 20 is elongated in structure and extend along the depth of the main housing 10. Thus, the unused towel roll 101 and the used towel roll 102 may be arranged and supported along a vertical direction of the main housing 10. This arrangement saves substantial space on the wall surface mounting the fabric towel dispenser of the present invention.

The guiding members 50 may be mounted and distributed in the receiving compartment 11 for guiding the towel sheet 100 to move therein. Each of the guiding members 50 may be configured as a guiding shaft and may be stationary or rotatable. The towel sheet 100 may be supported by the guiding members 50 as it moves from the unused towel roll 101 to the dispensing opening 12, and from the dispensing opening 12 to the used towel supporting shaft 20 to form the used towel roll 102. The exact number and positions of the guiding members 50 may be varied depending on the circumstances in which the towel sheet 100 is mounted in the receiving compartment 11. The guiding members 50 may also be provided depending on the traveling path of the towel sheet 100.

In the preferred embodiment of the present invention, the supporting panel 61 of the towel replacement arrangement 60 may be pivotally mounted in the receiving compartment 11 and may be detachably connected to the locking end portion 22 of the used towel supporting shaft 20. Thus, the connecting end portion 21 of the used towel supporting shaft 20 may be connected to the towel driving motor 42, while the locking end portion 22 of the used towel supporting shaft 20 may be detachably connected to the supporting panel 61.

As shown in FIG. 2 and FIG. 4 of the drawings, the supporting panel 61 may be mounted in the upper portion 13 of the main housing 10 at a position corresponding to the used towel supporting shaft 20 such that the supporting panel 61 may be selectively and downwardly flipped to connect to the used towel supporting shaft 20 so as to reinforce the used towel supporting shaft 20 and keep a rotation movement thereof. As described above, the supporting panel 61 may be operated between a locking mode and a releasing mode. When the supporting panel 61 is in the locking mode, the supporting panel 61 is downwardly and pivotally flipped and connect to the used towel supporting shaft 20 so that the supporting panel 61 may provide physical support to the used towel supporting shaft 20 and at the same time restrict a longitudinal movement thereof so as to prevent the used towel supporting shaft 20 from being taken out of the receiving compartment 11.

Figure 5:
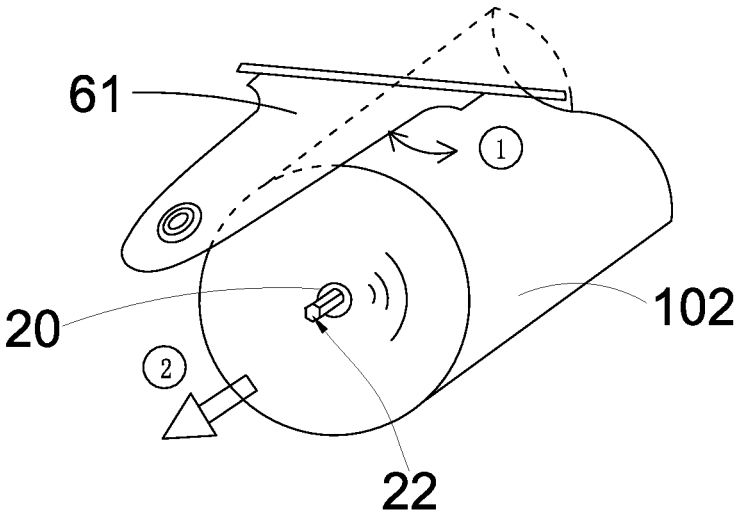
FIG. 5 is a schematic diagram of a used towel supporting shaft of the fabric towel dispenser according to the preferred embodiment of the present invention.
Figure 6:
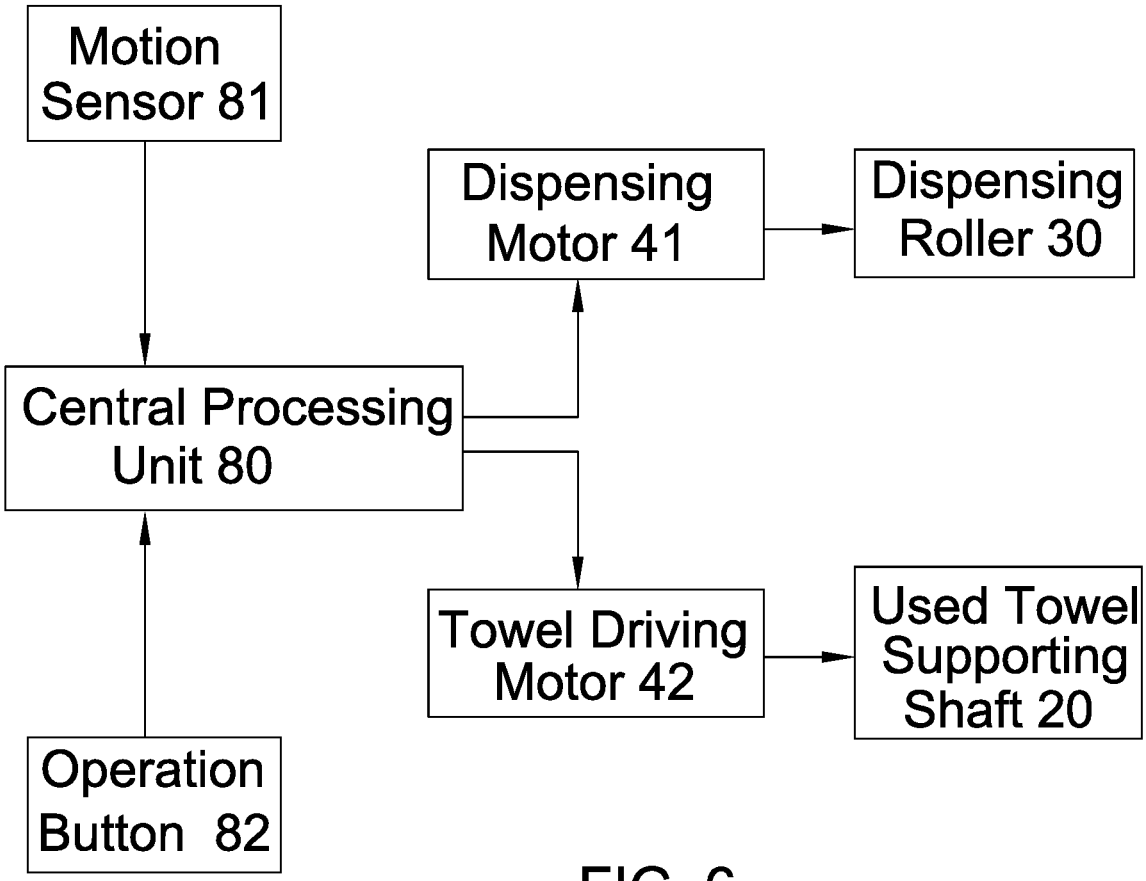
FIG. 6 is a block diagram illustrating electrical components of the fabric towel dispenser according to the preferred embodiment of the present invention.

On the other hand, as shown in FIG. 5 of the drawings, when the supporting panel 61 is in the releasing mode, the supporting panel 61 is upwardly and pivotally flipped away from the used towel supporting shaft 20 so as to allow a longitudinal movement of the used towel supporting shaft 20 and the used towel roll 102. As such, a user may be able to retrieve the used towel roll 102 from the receiving compartment 11 for convenient disposal. Moreover, a user may then be able to put a brand new unused towel roll 101 back to the receiving compartment 11 at a position below the used towel supporting shaft 20. Note that the used towel supporting shaft 20 needs or needs not be taken out from the receiving compartment 11 when the unused towel roll 102 is being replaced.

The fabric towel dispenser of the present invention may further comprise a central processing unit 80 provided in the receiving compartment 11 and electrically connected to the driving assembly 40 to control an operation thereof, and there can be motion sensor 81 provided on the main housing 10 for detecting user's motion in a designated sensing area, or there can be an operating button 82 provided on the main housing 10, which give the signal to the central processing unit 80.

The main housing 10 may further comprise a partitioning member 16 movably provided in the receiving compartment 11 at a position above the used towel supporting shaft 20. The partitioning member 16 may be arranged to separate the used towel roll 101 and the unused towel roll 102 for hygienic purpose. In the preferred embodiment of the present invention, the partitioning member 16 may pivotally move upwardly or downwardly with respect to a longitudinal direction of the main housing 10. When a diameter of the used towel roll 101 gradually increases, the partitioning member 16 may pivotally and gradually move downwardly corresponding to a change of size of the used towel roll 101. In other words, the partitioning member 16 may pivotally move according to a relative size of the used towel roll 101 and the unused towel roll 102. The partitioning member may be configured from rigid or deformable material such as metal, plastic or fabric, etc.

The operation of the present invention is as follows: unused towel sheet 100 may be initially mounted in the receiving compartment 11 of the main housing 10 to form an unused towel roll 101 which may be disposed in the lower portion 14 of the main housing 10. Certain portions of the towel sheet 100 may be pre-mounted and supported by the guiding members 50 and the dispensing roller 30, and may be initially attached on the used towel supporting shaft 20 for allowing the towel sheet 100 to be driven to move in the receiving compartment 11 in a predetermined path as supported and guided by the guiding members 50.

When a hand is in the sensing area or an actuation button is depressed, the dispensing roller 30 may be activated to drive the towel sheet 100 to be dispensed out of the dispensing opening 12 for allowing the towel sheet 100 to form the towel loop. Thus, certain unused portion of the towel sheet 100 may be driven to move downwardly with respect to the main housing 10 and pass through the dispensing opening 12 to form the towel loop as illustrated in FIG. 2 of the drawings. The user may then be able to grab on the towel loop for allowing the exposed towel sheet to absorb moisture from his hands. When moisture absorption has been completed, the hands may move out of the sensing area and the used towel supporting shaft 20 may be driven to rotate for retracting the towel loop. The used towel sheet 100 may then be driven to move upwardly along the main housing 10 and retracted and collected on the used towel supporting shaft 20 to gradually form the used towel roll 102. The used towel roll 102 may be supported on the used towel supporting shaft 20 until being replaced.

When the used towel roll 102 needs to be disposed, a user may open the front panel 15 of the main housing 10, unlock the supporting panel 61, and turn the supporting panel 61 into the releasing mode. The user may pivotally move the supporting panel 61 so as to allow the used towel supporting shaft 20 to be taken out from the receiving compartment 11. Alternatively, the used towel roll 102 may be taken out from the receiving compartment without removing the used towel supporting shaft 20. Thus, the used towel supporting shaft 20 may or may not be taken out from the receiving compartment 11.

When the used towel roll 102 has been disposed, the user may put in an unused towel roll 101 on the support groove 17 which is in the lower portion 14 of the main housing 10 and attach the some portions of the unused towel sheet 100 on the guiding members 50 and the used towel supporting shaft 20 for initially setting up an entire system for performing another cycle of the operations as described above.

One skilled in the art would appreciate that the above-mentioned preferred embodiment may have several alternative configurations which are within the scope of the present invention and needs to be protected. These alternative configurations are described below.

Figure 7:
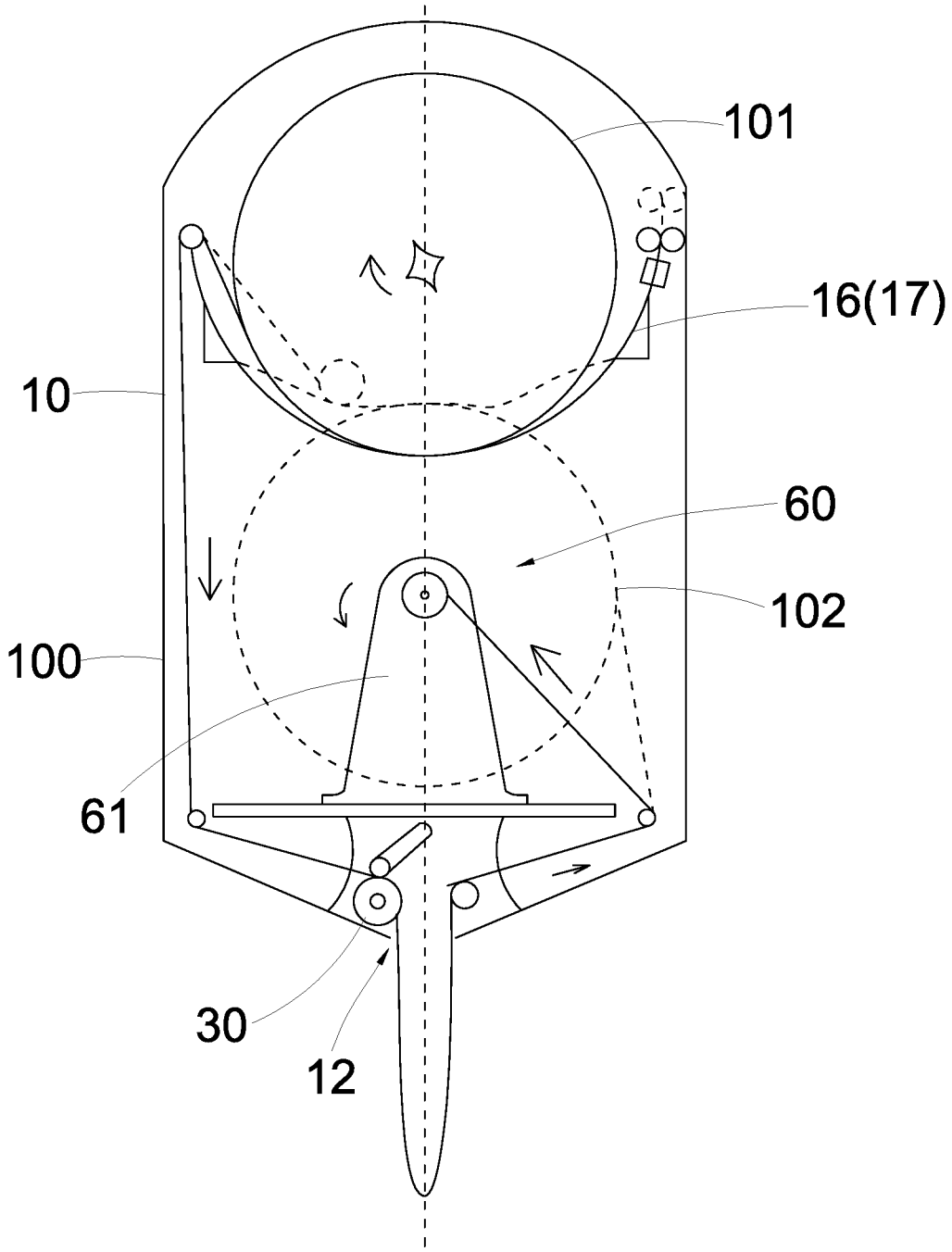
FIG. 7 is a first alternative mode of the fabric towel dispenser according to the preferred embodiment of the present invention.
Figure 8:
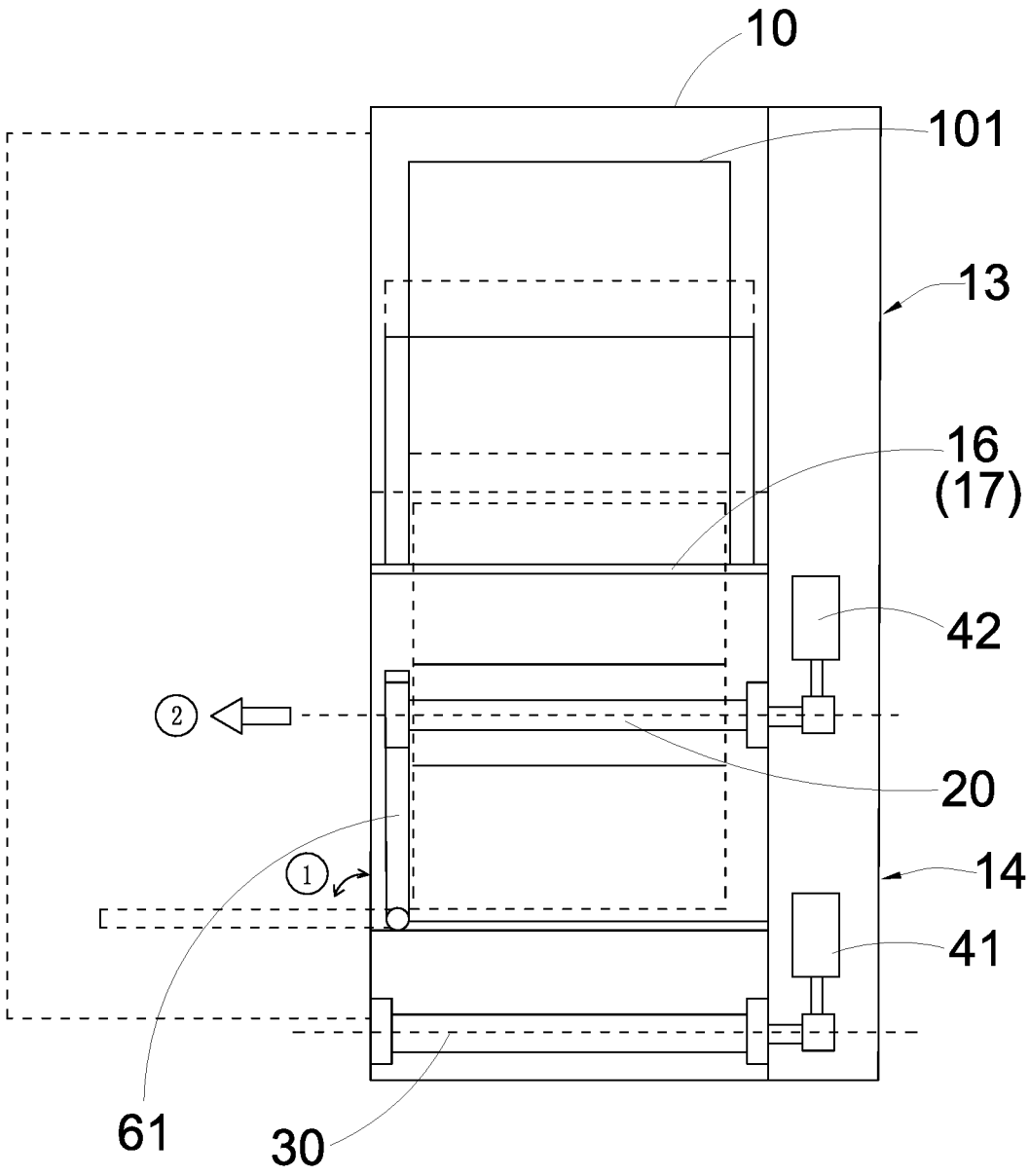
FIG. 8 is a side view of the fabric towel dispenser according to the first alternative mode of the preferred embodiment of the present invention.

Referring to FIG. 7 to FIG. 8 of the drawing, a first alternative mode of the fabric towel dispenser according to the preferred embodiment of the present invention is illustrated. The first alternative mode is similar to the preferred embodiment described above in FIG. 1 to FIG. 6, the difference being that the used towel supporting shaft 20 may now be mounted on the lower portion 14 of the main housing 10 so that the unused towel roll 101 may be supported on the upper portion 13 of the main housing.

Thus, the main housing 10 may further comprise a support groove 17 which also act as a partitioning member 16 provided in the receiving compartment 11 at a position above the used towel supporting shaft 20, wherein the unused towel roll 101 may be supported on the partitioning member 16, while the used towel supporting shaft 20 may be horizontally supported in the receiving compartment 11 at a position below the partitioning member 16.

Furthermore, the supporting panel 61 of the towel replacement arrangement 60 may be supported in the receiving compartment 11 at a position corresponding to the used towel supporting shaft 20 (now in the lower portion 14 of the main housing 10). When the supporting panel 61 is in the locking position, the supporting panel 61 may be upwardly and pivotally flipped to connect to and reinforce the used towel supporting shaft 20. When the supporting panel 61 is in the releasing position, the supporting panel 61 may be downwardly and pivotally flipped to allow the used towel supporting shaft 20 and/or the used towel roll 102 to be taken out from the receiving compartment 11 for disposal thereof. The used towel supporting shaft 20 needs or needs not be taken out from the receiving compartment 11 when the unused towel roll 102 is being replaced.

In this first alternative mode, the dispenser roller 30 may be mounted in the main housing 10 at a position adjacent to the dispensing opening 12 for driving the unused towel sheet 100 out of the dispensing opening 12 to form the towel loop. This is structurally identical to the preferred embodiment described above. The used towel supporting shaft 20 may perpendicularly extend from the wall surface on which the main housing 10 is mounted, and may be parallel to the dispenser roller 30.

In this first alternative mode, the partitioning member 16 may be arranged to separate the used towel roll 101 and the unused towel roll 102 for hygienic purpose. Moreover, the partitioning member 16 may be movably or/and deformably mounted in the receiving compartment 11 so that it may move or/and deform upwardly or downwardly with respect to a longitudinal direction of the main housing 10. When a diameter of the used towel roll 101 gradually increases, the partitioning member 16 may gradually move or/and deform upwardly corresponding to a change of size of the used towel roll 101. In other words, the partitioning member 16 may move or/and deform according to a relative size of the used towel roll 101 and the unused towel roll 102.

The partitioning member 16 may be configured from rigid or deformable material such as metal or plastic, etc. The partitioning member 16 may have a curved contour. The partitioning member 16 may move or/and deform corresponding to a relative size of the used towel roll 101 and the unused towel roll 102. The partitioning member 16 may be used to support the unused towel roll 101. Thus, the partitioning member 16 may be configured from a material which may deform or/and move according to a relative size of the used towel roll 101 and the unused towel roll 102 in the receiving compartment 11.

Figure 9:
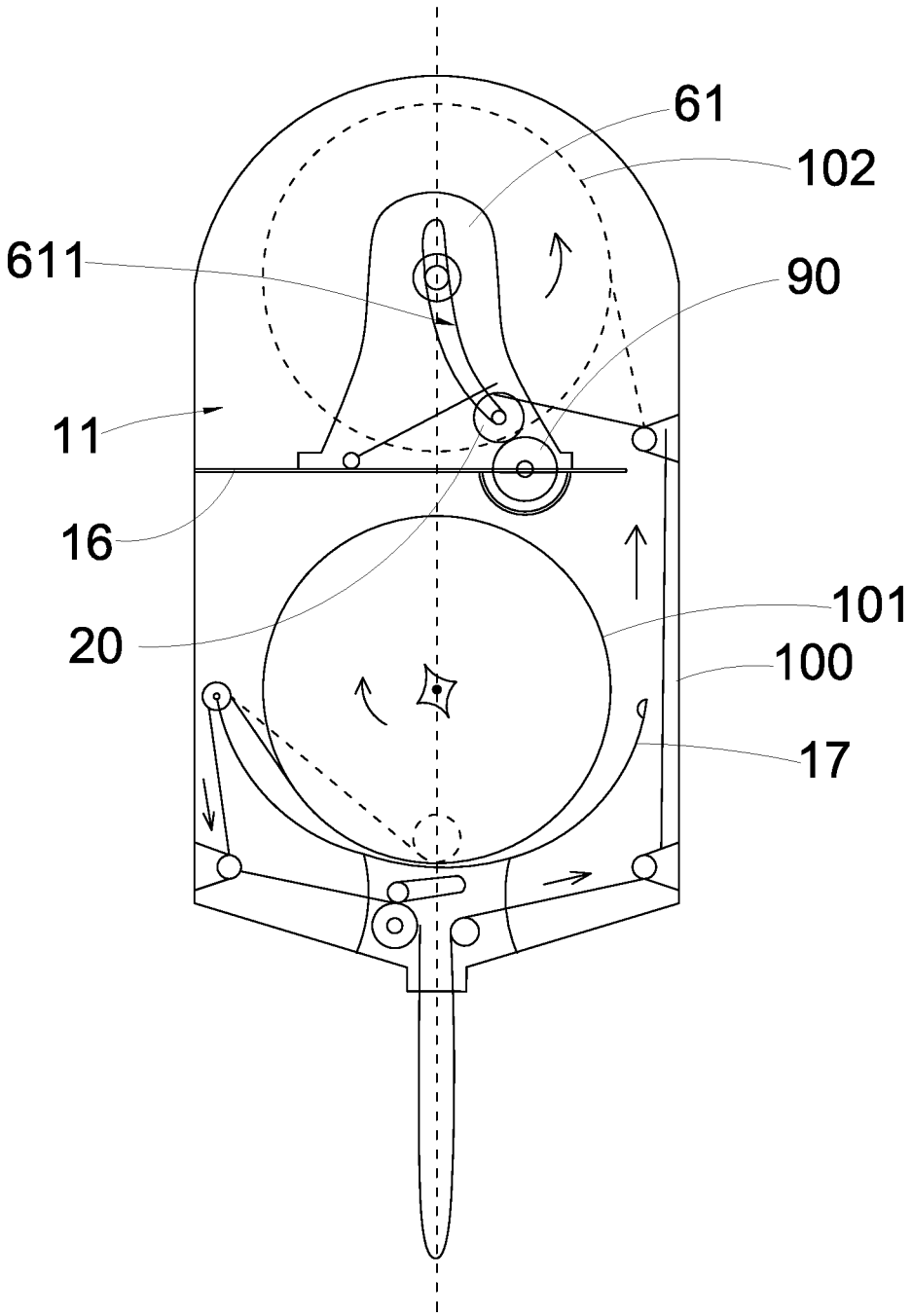
FIG. 9 is a second alternative mode of the fabric towel dispenser according to the preferred embodiment of the present invention.
Figure 10:
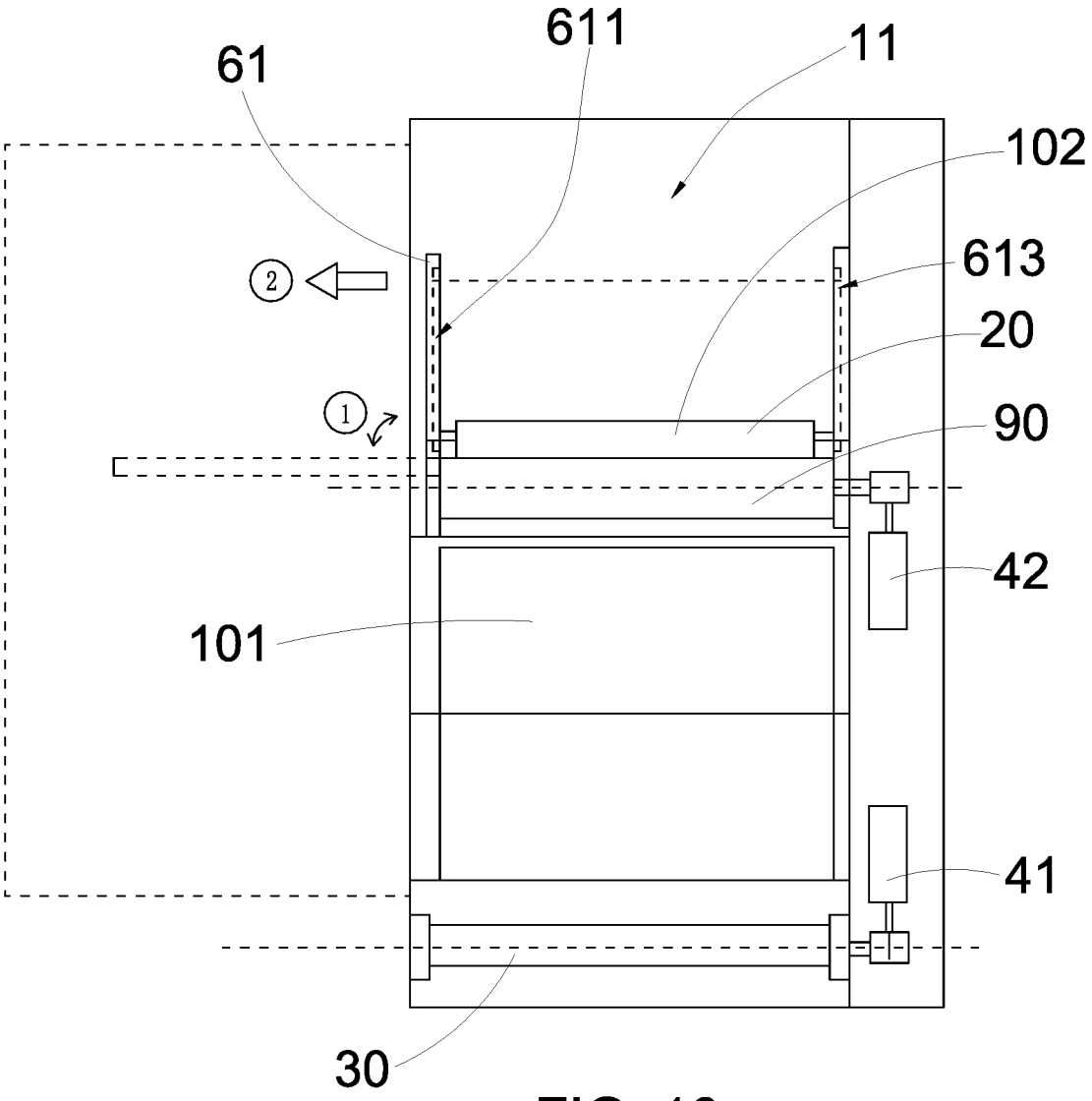
FIG. 10 is a side view of the fabric towel dispenser according to the second alternative mode of the preferred embodiment of the present invention.

Referring to FIG. 9 and FIG. 10 of the drawing, a second alternative mode of the fabric towel dispenser according to the preferred embodiment of the present invention is illustrated. The second alternative mode is similar to the preferred embodiment described above, except the fabric towel dispenser may further comprise a retraction roller 90 mounted in the receiving compartment 11 and for driving the towel sheet 100 to be retracted and collected on the used towel supporting shaft 20, wherein the towel driving motor 42 may be connected to the retraction roller 90 for driving the retraction roller 90 to rotate.

Moreover, the supporting panel 61 may further has a guiding slot 611, on the inner side of main housing 10, there has a guiding slot 613 with a symmetrical shape and position, wherein the used towel supporting shaft 20 may movably and rotatably engaged with the guiding slot 611 and 613 in such a manner that the used towel supporting shaft 20 may move linearly along the guiding slot 611 and 613. As shown in FIG. 9 of the drawings, the guiding slot 611 may have a curved contour and may be formed on the supporting panel 61 along a longitudinal direction thereof. The used towel supporting shaft 20 may upwardly or downwardly move along the guiding slot 611 and 613.

The retraction roller 90 may be in frictional contact with the towel sheet 100 which is also arranged to engage with the used towel supporting shaft 20. When the retraction roller 90 is driven to rotate by the towel driving motor 42, the towel sheet 100 may be driven to move and retracted and rolled on the used towel supporting shaft 20 to form the used towel roll 102. When more and more used towel sheet 100 is rolled, a diameter of the used towel roll 102 will gradually increase. As such, the used towel supporting shaft 20 may be forced to move up along the guiding slot 611 so as to make room for accommodating the used towel roll 102.

In this second alternative mode, the main housing 10 may further comprise a partitioning member 16 provided in the receiving compartment 11 at a position below the used towel supporting shaft 20, wherein the retraction roller 90 may be supported on the partitioning member 16, while the used towel supporting shaft 20 may be horizontally supported in the receiving compartment 11 at a position above the partitioning member 16.

In addition, the supporting panel 61 may be pivotally mounted on the partitioning member 16 to operate between the locking mode and the releasing mode. In the locking mode, the used towel supporting shaft 20 is locked on the supporting panel 61 at the guiding slot 611 so that the used towel supporting shaft 20 is retained in the receiving compartment 11. In the releasing mode, the connection between the supporting panel 61 and the used towel supporting shaft 20 may be unlocked, and the supporting panel 61 may be pivotally and downwardly moved to detach from the used towel supporting shaft 20 so as to allow the used towel supporting shaft 20 and the used towel roll 102 to be removed from the receiving compartment 11. The used towel roll 102 may then be disposed and replaced by an unused towel roll 101 installed underneath the partitioning member 16.

Figure 11:
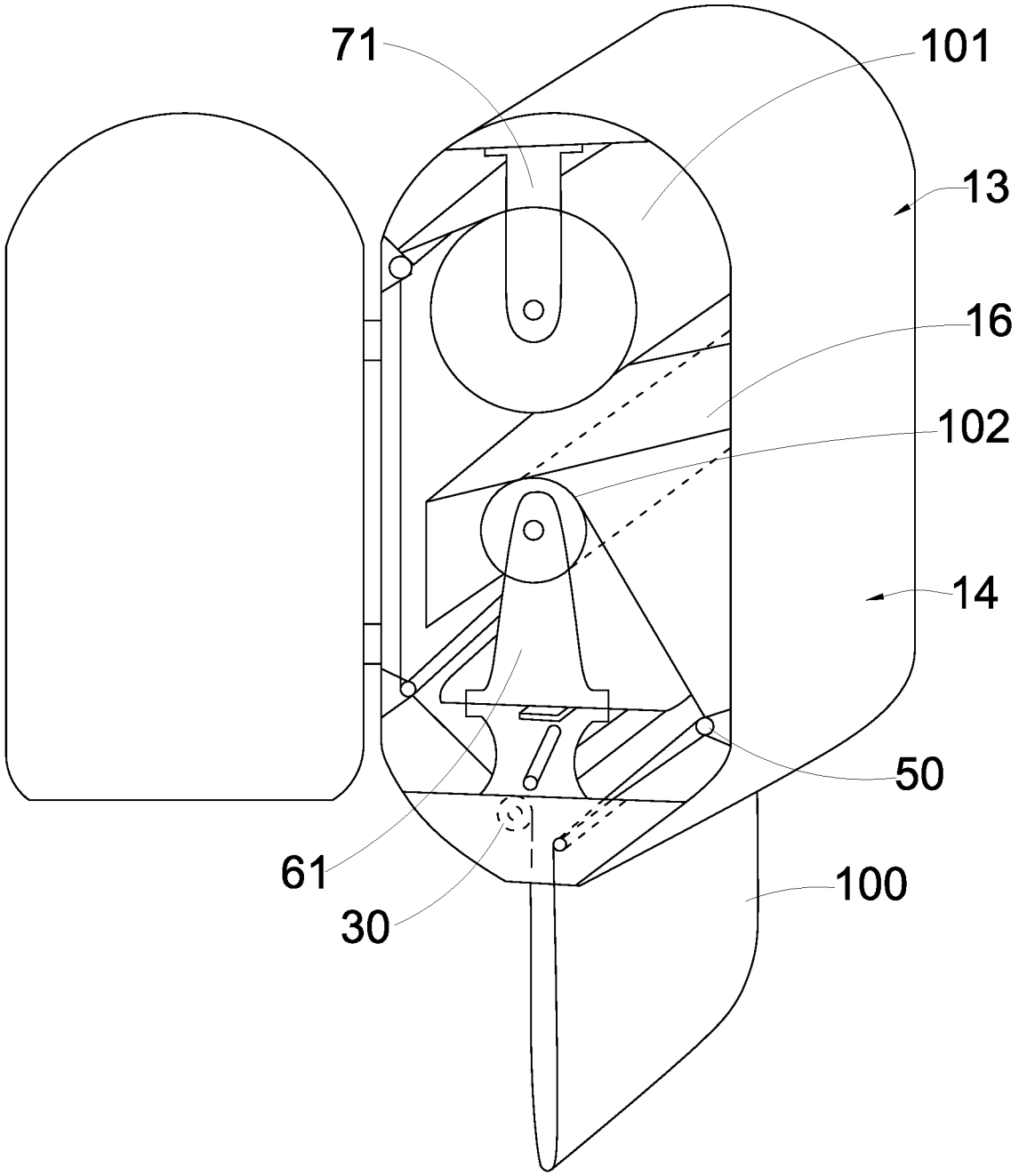
FIG. 11 is a third alternative mode of the fabric towel dispenser according to the preferred embodiment of the present invention.
Figure 12:
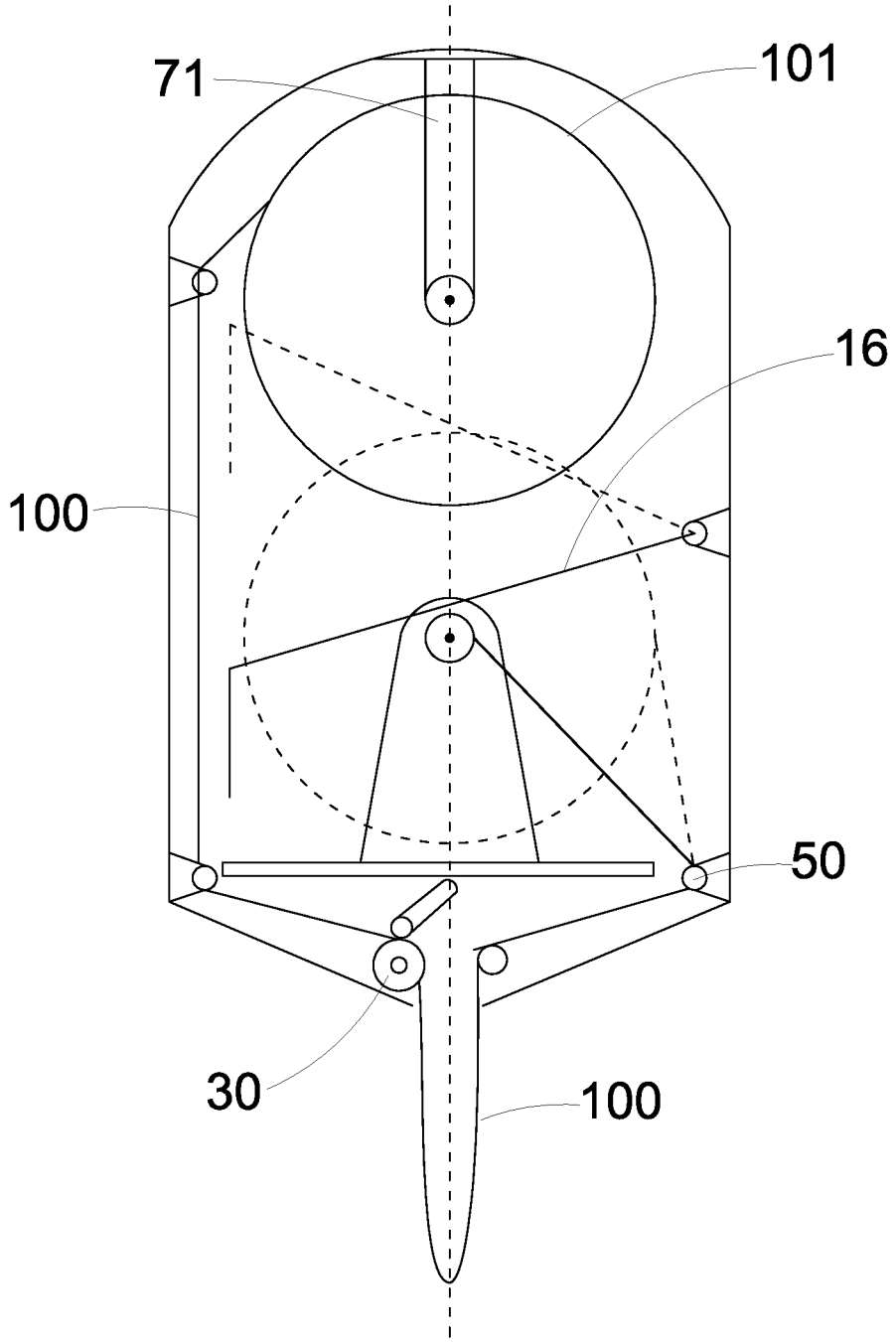
FIG. 12 is a front view of the third alternative mode of the fabric towel dispenser according to the preferred embodiment of the present invention.
Figure 13:
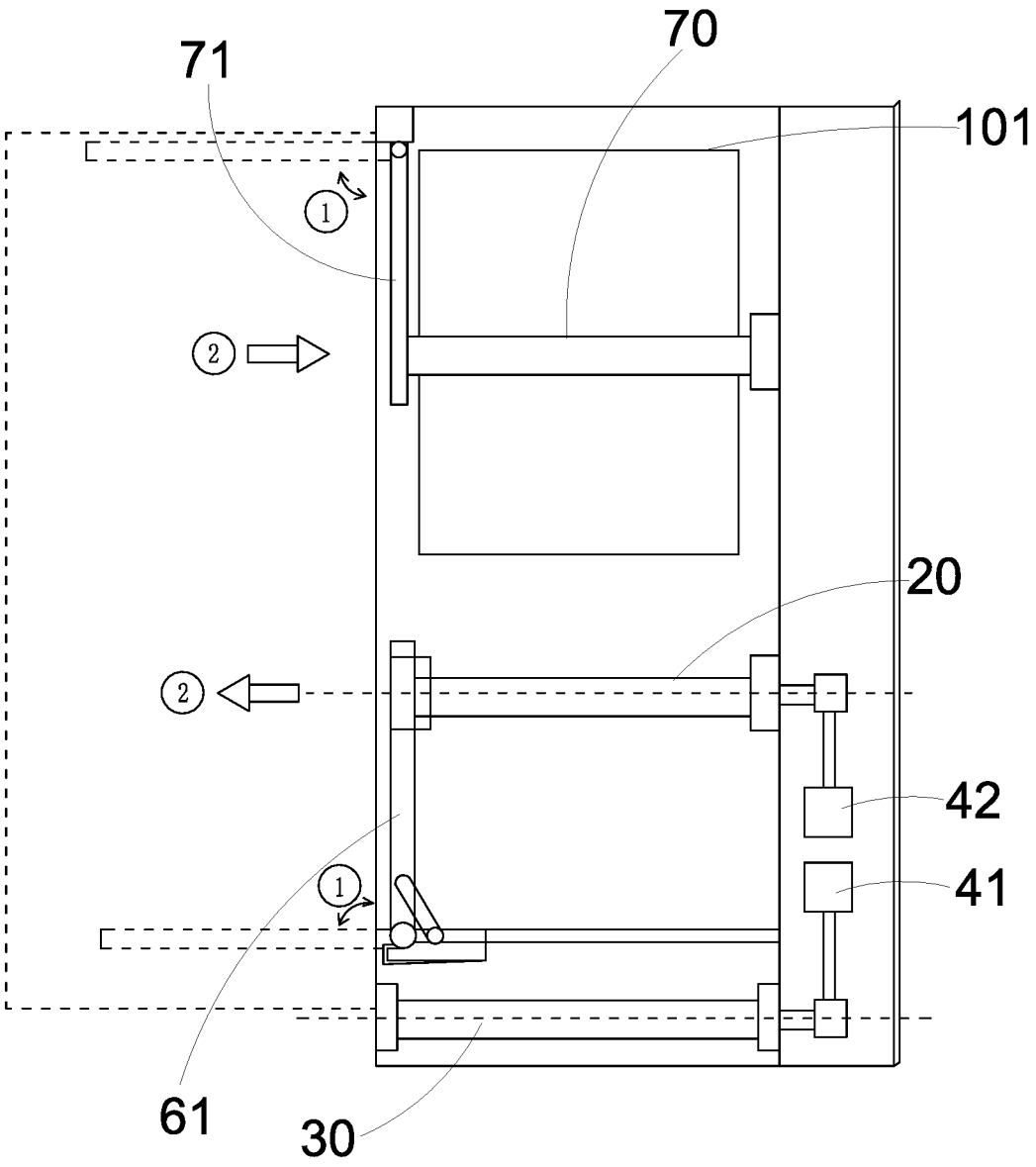
FIG. 13 is a side view of the third alternative mode of the fabric towel dispenser according to the preferred embodiment of the present invention.

Referring to FIG. 11 to FIG. 13 of the drawings, a third alternative mode of the fabric towel dispenser according to the preferred embodiment of the present invention is illustrated. The third alternative mode is similar to the first alternative mode described above. The used towel supporting shaft 20 is provided on the lower portion 14 of the main housing 10 in the receiving compartment 11.

Moreover, the fabric towel dispenser may further comprise a reinforcing member 71 and an unused towel supporting shaft 70 all mounted on the upper portion 13 of the main housing 10 in the receiving compartment 11. The unused towel supporting shaft 70 may be arranged to support the unused towel roll 101 at the upper portion 13 of the main housing 10. The unused towel supporting shaft 70 has one end supported by the main housing 10, and another end detachably mounted on the supporting panel 71. As shown in FIG. 13 of the drawings, the reinforcing member 71 may be pivotally mounted on the upper portion 13 of the main housing 10 in such a manner that the reinforcing member 71 may be pivotally and downwardly moved to lock up a position of the unused towel supporting shaft 70, or pivotally and upwardly moved to unblock a moving path thereof so as to allow a user to take out or mount the unused towel supporting shaft 70 from or in the receiving compartment 11.

As shown in FIG. 11 of the drawings, the reinforcing member 71 may be pivotally moved toward the unused towel roll 101 and detachably connect to the unused towel supporting shaft 70 so as to retain the unused towel supporting shaft 70 and unused towel roll 101 in position in the receiving compartment 11. On the other hand, as shown in FIG. 13 of the drawings, the reinforcing member 71 may be pivotally moved away from the unused towel supporting shaft 70 for allowing a user to take out the unused towel supporting shaft 70 or mount the unused towel sheet 100 in the receiving compartment 11.

The main housing 10 may further comprise a partitioning member 16 movably mounted in the receiving compartment 11 at a position above the used towel supporting shaft 20, wherein the used towel supporting shaft 20 is horizontally supported in the receiving compartment 11 at a position below the partitioning member 16.

As shown in FIG. 12 of the drawings, the partitioning member 16 may be mounted in the receiving compartment 11 in a pivotally movable manner so that the partitioning member 16 may initially rest on the used towel supporting shaft 20. When the used towel supporting shaft 20 collects unused towel sheet 100 and size of the used towel roll 102 gradually increases, the partitioning member 16 may be arranged to pivotally and upwardly move in the receiving compartment 11 corresponding to the size of the used towel roll 102. The partitioning member 16 may be arranged to separate the used towel roll 101 and the unused towel roll 102 for hygienic purpose. The partitioning member may be configured from rigid or deformable material such as metal, plastic or fabric, etc.

Figure 14:
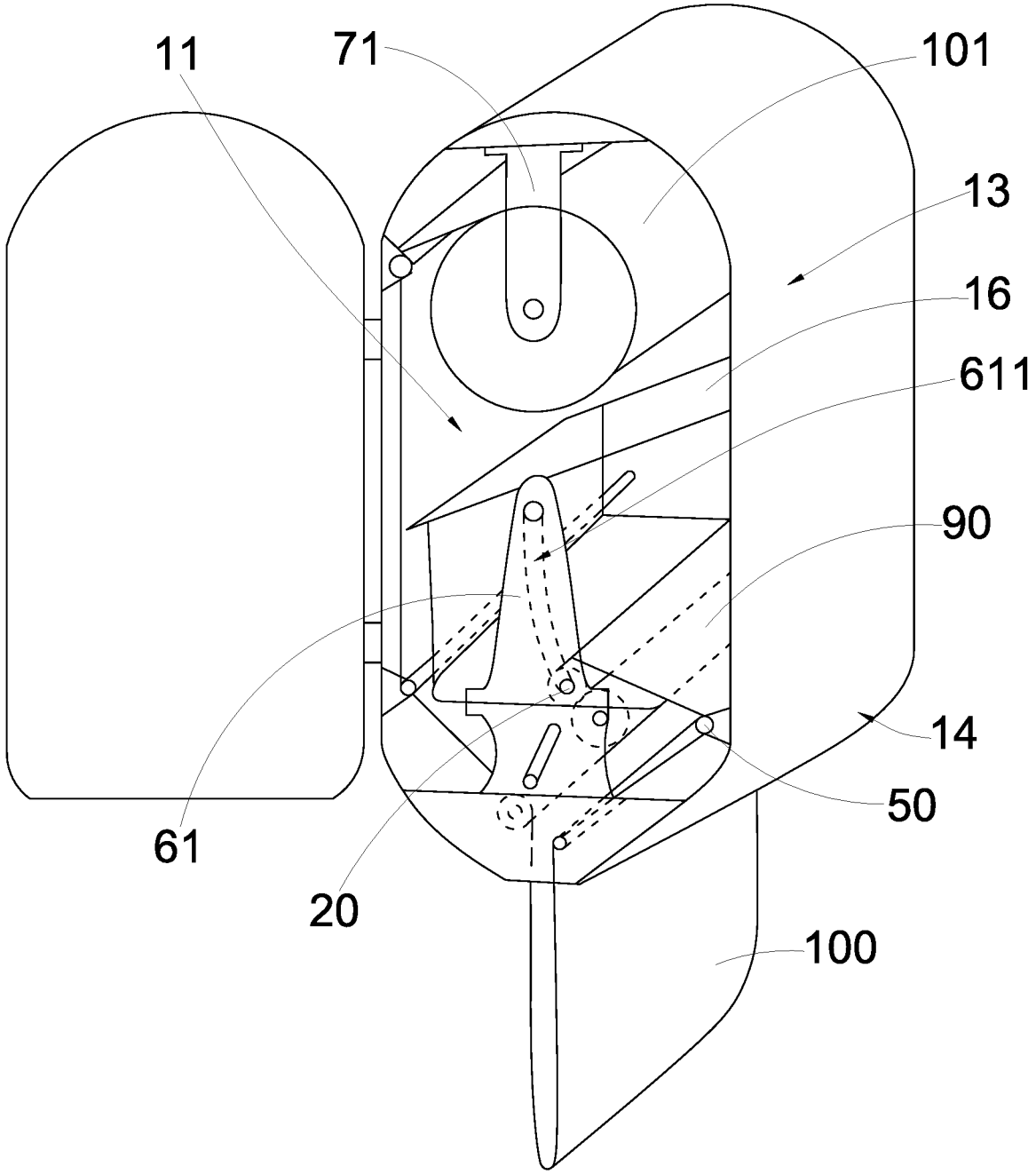
FIG. 14 is a fourth alternative mode of the fabric towel dispenser according to the preferred embodiment of the present invention.
Figure 15:
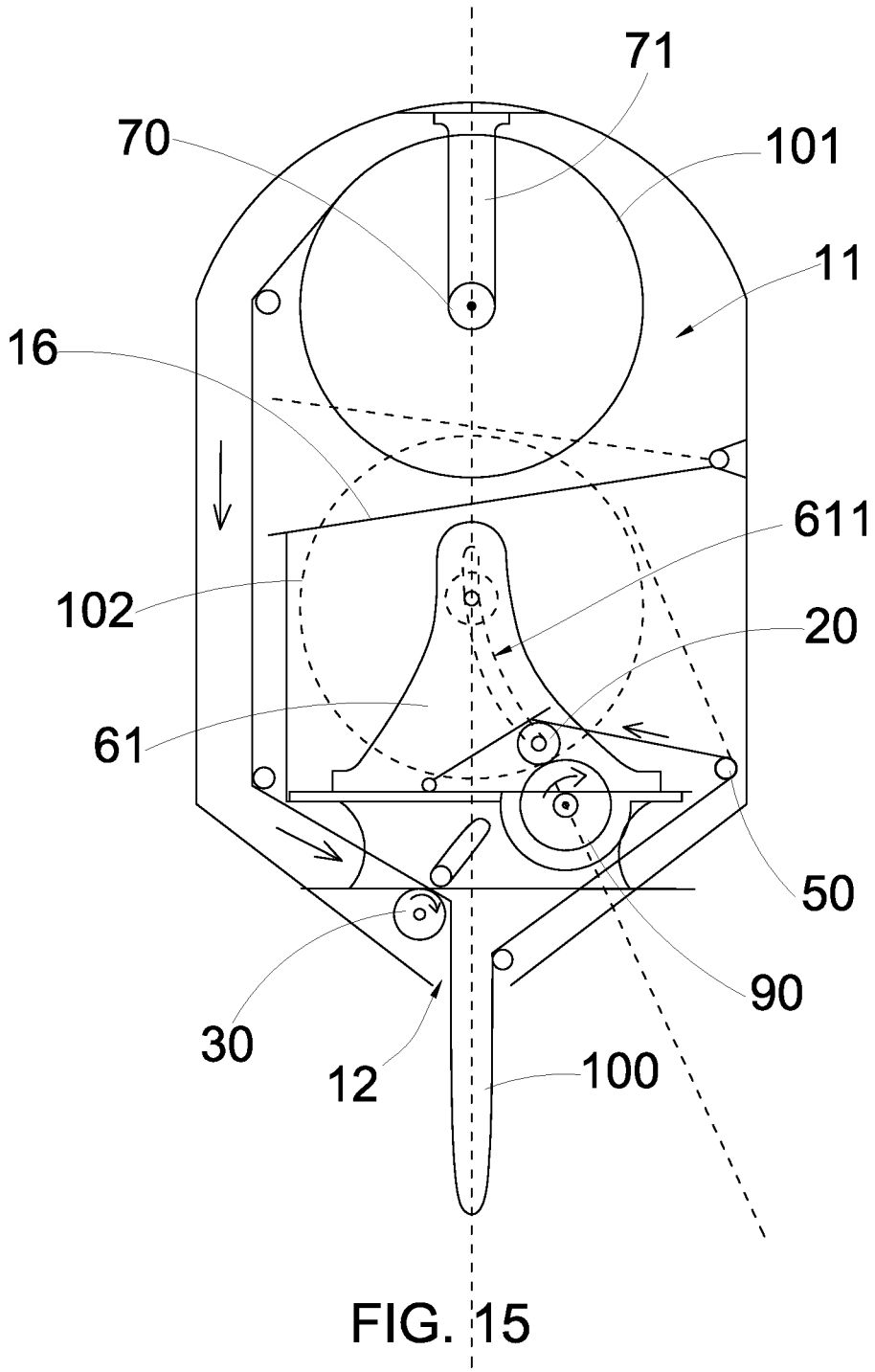
FIG. 15 is a front view of the fourth alternative mode of the fabric towel dispenser according to the preferred embodiment of the present invention.
Figure 16:
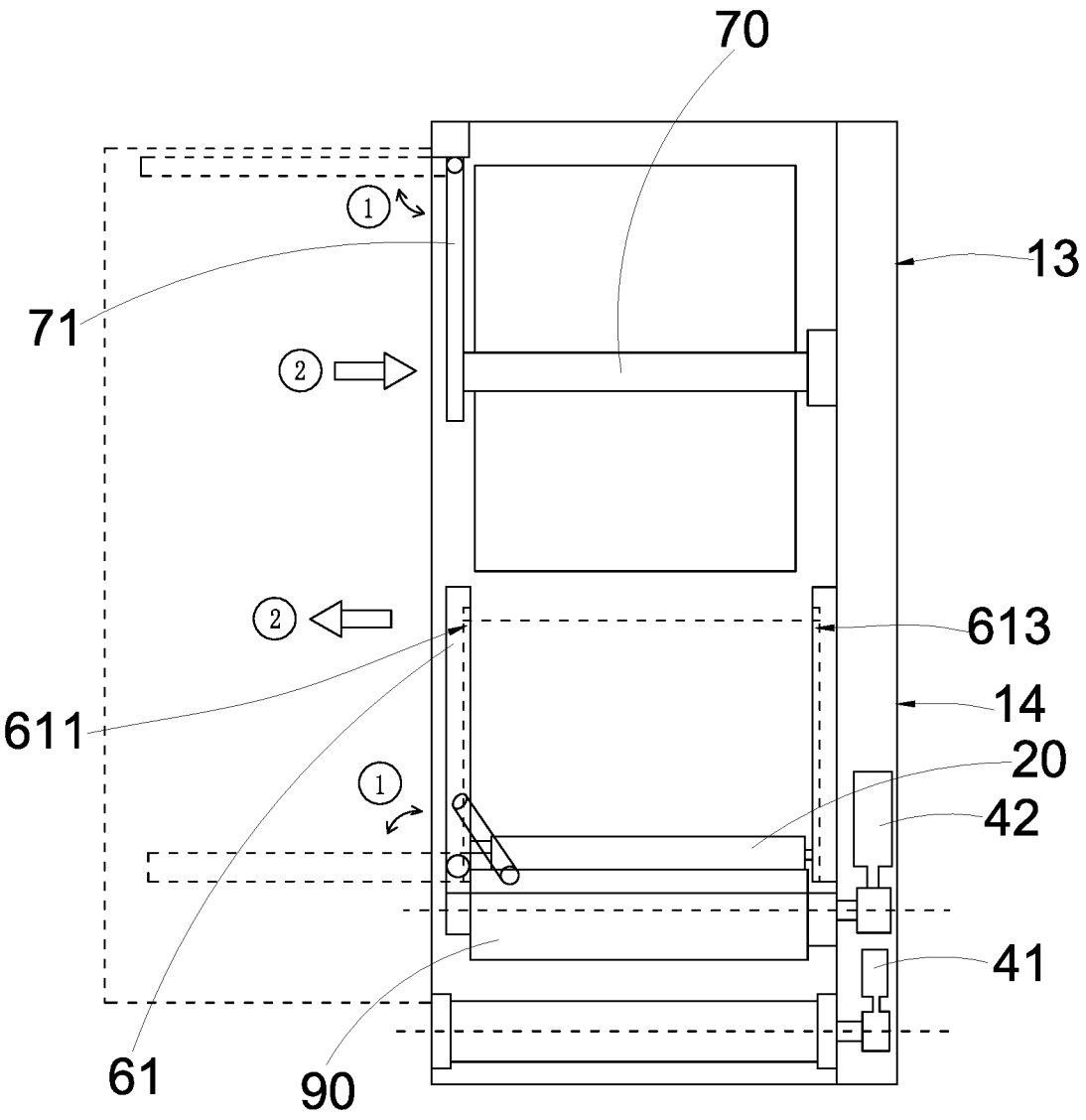
FIG. 16 is a side view of the fourth alternative mode of the fabric towel dispenser according to the preferred embodiment of the present invention.

Referring to FIG. 14 to FIG. 16 of the drawings, a fourth alternative mode of the fabric towel dispenser according to the preferred embodiment of the present invention is illustrated. The fourth alternative mode is similar to the third alternative mode described above (FIG. 9), except that the retraction roller 90 is now provided on the lower portion 14 of the main housing 10. Moreover, the used towel supporting shaft 20 and the supporting panel 61 may also be provided on the lower portion 14 of the main housing 10 in the receiving compartment 11.

According to the fourth alternative mode of the present invention, the retraction roller 90 may be mounted in the receiving compartment 11 and for driving the towel sheet 100 to be retracted and collected on the used towel supporting shaft 20, wherein the towel driving motor 42 may be connected to the retraction roller 90 for driving the retraction roller 90 to rotate.

Moreover, the supporting panel 61 may further has a guiding slot 611, on the inner side of main housing 10, there has a guiding slot 613 with a symmetrical shape and position, wherein the used towel supporting shaft 20 may movably and rotatably engage with the guiding slot 611 and 613 in such a manner that the used towel supporting shaft 20 may move along the guiding slot 611 and 613. As shown in FIG. 14-16 of the drawings, the guiding slot 611 may have a curved contour and may be formed on the supporting panel 61 along a longitudinal direction thereof. The used towel supporting shaft 20 may upwardly or downwardly move along the guiding slot 611 and 613.

The retraction roller 90 may be in frictional contact with the towel sheet 100 which is also arranged to engage with the used towel supporting shaft 20. When the retraction roller 90 is driven to rotate by the towel driving motor 42, the towel sheet 100 may be driven to move and retracted and rolled on the used towel supporting shaft 20 to form the used towel roll 102. When more and more used towel sheet 100 is rolled, a diameter of the used towel roll 102 will gradually increase. As such, the used towel supporting shaft 20 may be forced to move up along the guiding slot 611 so as to make room for accommodating the used towel roll 102.

The supporting panel 61 may be pivotally mounted on the main housing 10 at the lower portion 14 thereof to operate between the locking mode and the releasing mode. In the locking mode, the used towel supporting shaft 20 is locked on the supporting panel 61 at the guiding slot 611 so that the used towel supporting shaft 20 is retained in the receiving compartment 11. In the releasing mode, the connection between the supporting panel 61 and the used towel supporting shaft 20 may be unlocked, and the supporting panel 61 may be pivotally moved to detach from the used towel supporting shaft 20 so as to allow the used towel supporting shaft 20 and the used towel roll 102 to be removed from the receiving compartment 11. The used towel roll 102 may then be disposed, and an unused towel roll 101 may be installed underneath the partitioning member 16. The used towel supporting shaft 20 needs or needs not be taken out from the receiving compartment 11 when the unused towel roll 102 is being replaced.

As shown in FIG. 14 and FIG. 15 of the drawings, the main housing 10 may further comprise a partitioning member 16 movably or/and deformably mounted in the receiving compartment 11 at a position above the used towel supporting shaft 20, wherein the used towel supporting shaft 20 is horizontally supported in the receiving compartment 11 at a position below the partitioning member 16. The partitioning member 16 may be mounted in the receiving compartment 11 in a pivotally movable manner so that the partitioning member 16 may initially rest on the supporting panel 61 or the used towel roll 102. When the used towel supporting shaft 20 collects unused towel sheet 100 and size of the used towel roll 102 gradually increases, the partitioning member 16 may be arranged to pivotally and upwardly move in the receiving compartment 11 corresponding to the size of the used towel roll 102. The partitioning member 16 may be arranged to separate the used towel roll 101 and the unused towel roll 102 for hygienic purpose. The partitioning member may be configured from rigid or deformable material such as metal, plastic or fabric, etc.

As shown in FIG. 15 to FIG. 16 of the drawings, the towel dispensing may further comprise an unused towel supporting shaft 70 mounted on the upper portion 13 of the main housing in the receiving compartment 11. The unused towel supporting shaft 70 may perpendicularly extend with respect to the wall surface on which the main housing 10 is mounted and may be arranged to support the unused towel roll 101 in a rotatably movable manner. The unused towel roll 101 may be supported by the unused towel supporting shaft 70. The unused towel supporting shaft 70 may be configured as having an elongated structure and extend along the depth of the main housing 10.

Moreover, the fabric towel dispenser may further comprise a reinforcing member 71 mounted on the upper portion 13 of the main housing 10 in the receiving compartment 11. The unused towel supporting shaft 70 has one end supported by the main housing 10, and another end detachably mounted on the reinforcing member 71. The reinforcing member 71 may be pivotally mounted on the upper portion 13 of the main housing 10 in such a manner that the reinforcing member 71 may be pivotally moved to lock up a position of the unused towel supporting shaft 70, or pivotally moved to unblock a moving path thereof so as to allow a user to take out or mount the unused towel supporting shaft 70 from or in the receiving compartment 11.

It is important to mention that the first through fourth alternatives are merely examples of alternatives of the preferred embodiment. One skilled in the art would appreciate that the features described in first through fourth alternatives above may be combined or interchanged without violating the spirits of the present invention.

Figure 17:
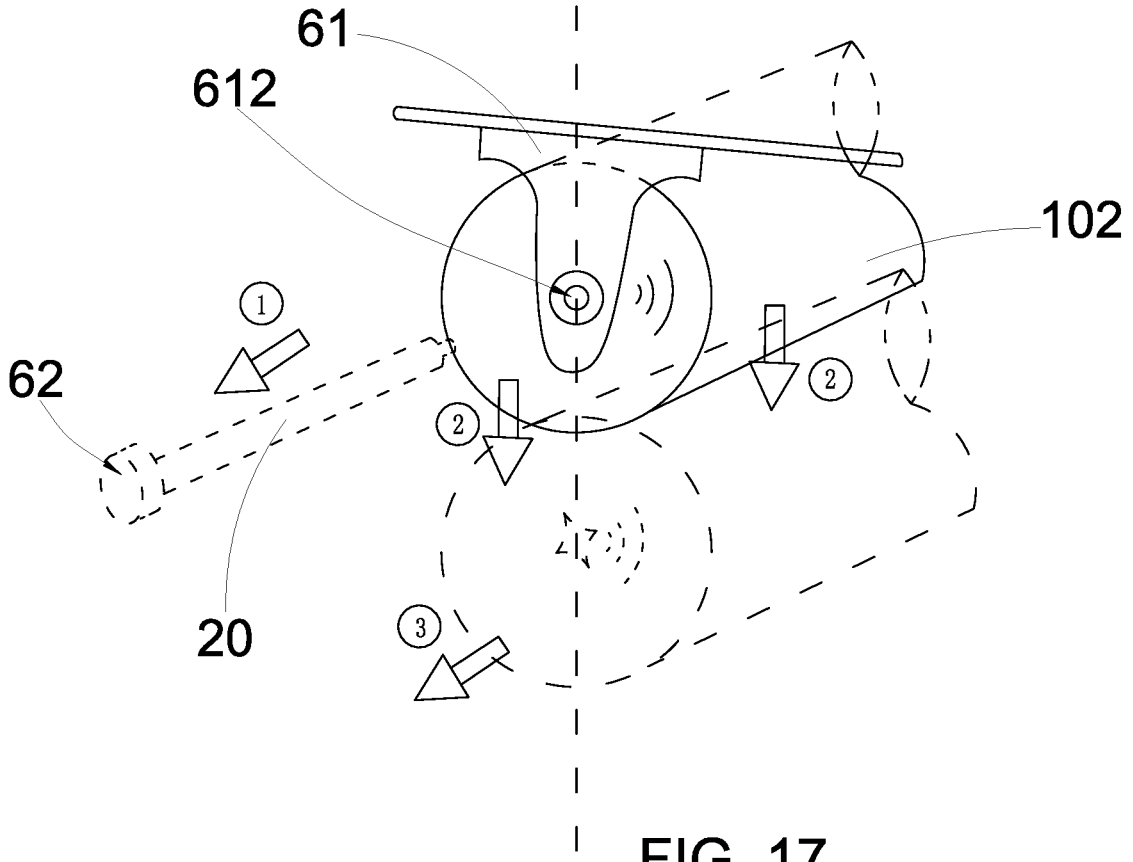
FIG. 17 is a fifth alternative mode of the fabric towel dispenser according to the preferred embodiment of the present invention.

Referring to FIG. 17 of the drawings, a fifth alternative mode of the fabric towel dispenser according to the preferred embodiment of the present invention is illustrated. The fifth alternative mode illustrates another possibility on the part of the towel replacement arrangement 60 on top of the first through fourth alternative described above. In this fifth alternative mode, the supporting panel 61 of the roller replacement arrangement 60 is immovably mounted on the main housing 10 in the receiving compartment 11.

According to the fifth alternative mode of the present invention, the supporting panel 61 of the towel replacement arrangement 60 is securely mounted in the main housing 10 at a position corresponding to the used towel supporting shaft 20. When the supporting panel 61 is in the locking mode, the locking end portion 62 of the used towel supporting shaft 20 is locked to the supporting panel 61 so that the used towel supporting shaft 20 is securely retained and reinforced in the receiving compartment 11. As shown in FIG. 17 of the drawings, the supporting panel 61 may have a through hole 612, wherein the used towel supporting shaft 20 may penetrate the through hole 61 and the locking end portion 62 may be locked on the supporting panel 61, preferably through using the method of dislocate the multi-tooth baffle, threads or other arrangements on the used towel supporting shaft 20.

When the supporting panel 61 is in the releasing mode, the locking end portion 62 of the used towel supporting shaft 20 may be unlocked and taken out released from the supporting panel 61 preferably through the through hole 612, so that the used towel roll 102 will fall down inside the main housing 10. Coupled with the use of a deformable partitioning member, there will have space to take out used towel roll 102 from the receiving compartment 11.

This construction of the supporting panel 61 may be utilized in the preferred embodiment or any one of the first through fourth alternative mode described above.

Figure 18:
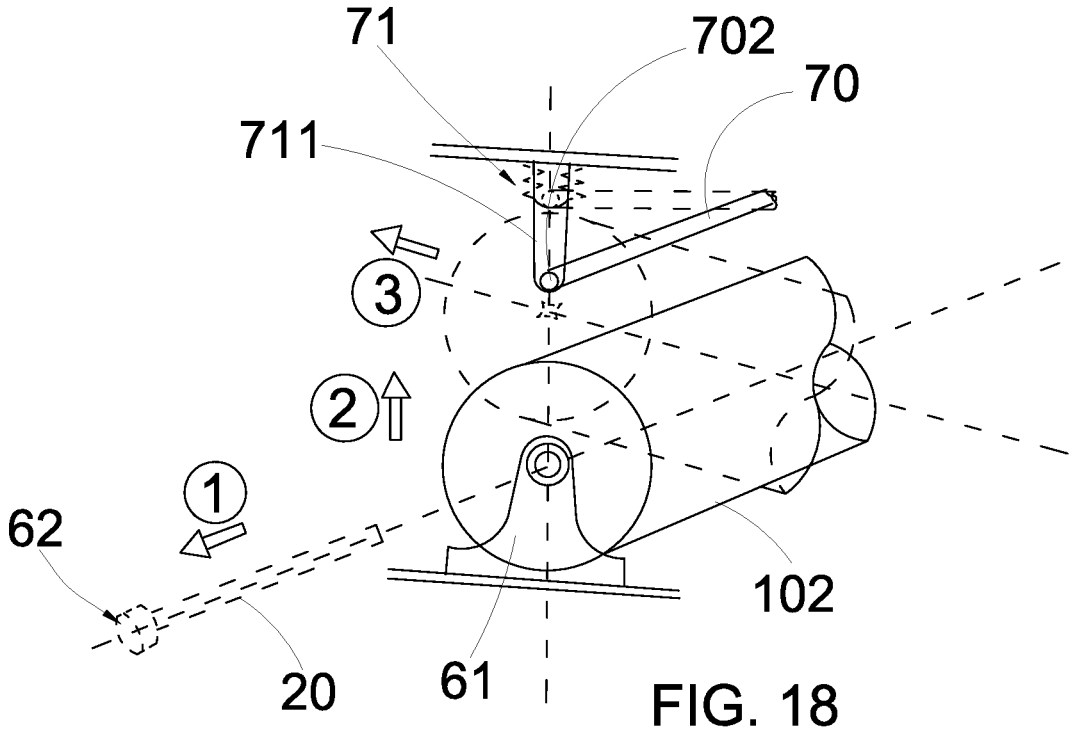
FIG. 18 is a sixth alternative mode of the fabric towel dispenser according to the preferred embodiment of the present invention.

Referring to FIG. 18 of the drawings, a sixth alternative mode of the fabric towel dispenser according to the preferred embodiment of the present invention, the third alternative mode and the fourth alternative mode is illustrated. The sixth alternative mode illustrates another possibility on the reinforcing member 71 on top of the first through fifth alternative described above. In this sixth alternative mode, the reinforcing member 71 is mounted on the main housing 10 and may be deformable and/or movable so as allow a user to conveniently access the unused towel supporting shaft 70 by deforming the reinforcing member 71.

According to the sixth alternative mode, the reinforcing member 71 may be deformable and/or movable and may take several physical forms. For example, the reinforcing member 71 may be configured as a deformable panel, a rope, a braided belt, a chain, soft board or the likes. The reinforcing member 71 may be configured from metallic material, fabric or soft material such as rubber. When the unused towel roll 101 is accommodated in the receiving compartment 11, an inner end 701 of the unused towel supporting shaft 70 may be connected to the main housing 10, and an outer end 702 of the unused towel supporting shaft 70 may be connected to the reinforcing member. When the used towel roll 102 is disassembled, the reinforcing member 71 may be deformed so as to give more space for the used towel roll 102 to be taken out from the receiving compartment 11. As shown in FIG. 18 of the drawings, the reinforcing member 71 may comprise an elongated band 711 mounted on the main housing 10 to form a loop for suspendedly supporting the outer end 702 of the unused towel supporting shaft 70. Thus, the elongated band 711 may be deformed to allow more space for a user to take out the used towel roll 102 from the receiving compartment 11.

It is worth mentioning that the reinforcing member 71 described in this sixth alternative mode may be adopted to modify the reinforcing member 71 described in the preferred embodiment, the third alternative mode and the fourth alternative mode. The supporting panel 61 of the towel replacement arrangement 60 may be securely or movably mounted in the main housing 10 at a position corresponding to the used towel supporting shaft 20.

The present invention, while illustrated and described in terms of a preferred embodiment and several alternatives, is not limited to the particular description contained in this specification. Additional alternative or equivalent components could also be used to practice the present invention.

What is claimed is:

1. A fabric towel dispenser mounted on a wall surface, comprising:

a main housing mounted on the wall surface and having a receiving compartment, and a dispensing opening which is substantially vertical to the wall surface communicating with the receiving compartment, the receiving compartment being adapted for receiving a roll of unused towel sheet which is substantially vertical to the wall surface;

a used towel supporting shaft extending perpendicular to the wall surface and being mounted in the main housing for supporting a roll of used towel sheet;

a dispensing roller supported in the main housing for driving the unused towel sheet out to be dispensed out of the dispensing opening;

a driving assembly mounted in the receiving compartment and connected to the used towel supporting shaft and the dispensing roller for sequentially driving the unused towel sheet to pass through the dispensing opening for dispensing, and to drive the used towel sheet to be retracted and collected by the used towel supporting shaft;

a plurality of guiding members mounted in the receiving compartment for guiding the roll of unused towel sheet to sequentially pass through the dispensing opening and collected by the used towel supporting shaft; and a partitioning member provided in the receiving compartment to separate the unused towel sheet and used towel sheet;

a towel replacement arrangement which comprises a supporting panel which is pivotally supported in the receiving compartment, and connected to the used towel supporting shaft, in such a manner that the supporting panel is capable of operating between a locking mode and a releasing mode, wherein in the locking mode, the supporting panel is securely connected to the used towel supporting shaft to lock up a position of the used towel supporting shaft in the receiving compartment, wherein in the releasing mode, the supporting panel is arranged to unlock the used towel supporting shaft for facilitating disposal of the used towel sheet.

2. The fabric towel dispenser, as recited in claim 1, wherein the main housing has an upper portion and a lower portion, wherein the used towel supporting shaft is horizontally supported on the upper portion of the main housing in the receiving compartment.

3. The fabric towel dispenser, as recited in claim 2, wherein the dispensing roller is mounted in the lower portion of the main housing at a position adjacent to the dispensing opening, the driving assembly comprising a dispensing motor mounted in the receiving compartment and operatively connected to the dispensing roller for driving the dispensing roller to rotate so as to drive the unused towel sheet to be dispensed out of the main housing through the dispensing opening.

4. The fabric towel dispenser, as recited in claim 3, wherein the driving assembly further comprises a towel driving motor mounted in the main housing and operatively connected to the used towel supporting shaft for driving the used towel supporting shaft to rotate for retracting used towel sheet thereon.

5. The fabric towel dispenser, as recited in claim 4, wherein the supporting panel is pivotally mounted in the upper portion of the main housing at a position corresponding to the used towel supporting shaft such that the supporting panel is capable of being selectively and downwardly flipped to connect to the used towel supporting shaft so as to reinforce the used towel supporting shaft and keep a rotation movement thereof when the supporting panel is in the locking mode, wherein when the supporting panel is in the releasing mode, the supporting panel is upwardly and pivotally flipped away from the used towel supporting shaft so as to facility to take out the roll of the used towel sheet.

6. The fabric towel dispenser, as recited in claim 1, wherein the main housing has an upper portion and a lower portion, wherein the used towel supporting shaft is horizontally supported on the lower portion of the main housing in the receiving compartment.

7. The fabric towel dispenser, as recited in claim 6, wherein the dispensing roller is mounted in the lower portion of the main housing at a position adjacent to the dispensing opening, the driving assembly comprising a dispensing motor mounted in the receiving compartment and operatively connected to the dispensing roller for driving the dispensing roller to rotate so as to drive the unused towel sheet to be dispensed out of the main housing through the dispensing opening.

8. The fabric towel dispenser, as recited in claim 7, wherein the driving assembly further comprises a towel driving motor mounted in the main housing and operatively connected to the used towel supporting shaft for driving the used towel supporting shaft to rotate for retracting the used towel sheet thereon.

9. The fabric towel dispenser, as recited in claim 8, wherein the supporting panel of the towel replacement arrangement is supported in the receiving compartment at the lower portion of the main housing and positioned corresponding to the used towel supporting shaft, wherein when the supporting panel is in the locking position, the supporting panel is capable of being upwardly and pivotally flipped to connect to and reinforce the used towel supporting shaft, wherein when the supporting panel is in the releasing position, the supporting panel is capable of being downwardly and pivotally flipped to allow the used towel supporting shaft and the roll of the used towel sheet to be taken out from the receiving compartment.

10. The fabric towel dispenser, as recited in claim 9, further comprising a reinforcing member and an unused towel supporting shaft mounted on the upper portion of the main housing in the receiving compartment, the unused towel supporting shaft being arranged to support the unused towel sheet at the upper portion of the main housing, wherein the reinforcing member is arranged to pivotally mount on the upper portion of the main housing in such a manner that the reinforcing member is capable of being pivotally and downwardly moved to lock up a position of the unused towel supporting shaft, and pivotally and upwardly moved to unblock a moving path thereof.

11. The fabric towel dispenser, as recited in claim 8, further comprising a reinforcing member and an unused towel supporting shaft mounted on the upper portion of the main housing in the receiving compartment, wherein the reinforcing member is deformable and movable, so as to allow extra space for the used towel supporting shaft to be taken out from the receiving compartment.

12. The fabric towel dispenser, as recited in claim 1, further comprising a retraction roller mounted in the receiving compartment and arranged to be in frictional contact with the towel sheet so as to drive the towel sheet to be retracted and collected on the used towel supporting shaft, wherein the towel driving motor is connected to the retraction roller for driving the retraction roller to rotate.

13. The fabric towel dispenser, as recited in claim 12, wherein the supporting panel further has a guiding slot, wherein the used towel supporting shaft is movably and rotatably engaged with the guiding slot in such a manner that the used towel supporting shaft is arranged to move linearly along the guiding slot, the guiding slot having a curved contour and being formed on the supporting panel along a longitudinal direction thereof, so that the used towel supporting shaft is arranged to move along a corresponding direction with respect to the guiding slot.

14. The fabric towel dispenser, as recited in claim 13, wherein the dispensing roller is mounted in the lower portion of the main housing at a position adjacent to the dispensing opening, the driving assembly comprising a dispensing motor mounted in the receiving compartment and operatively connected to the dispensing roller for driving the dispensing roller to rotate so as to drive the unused towel sheet to be dispensed out of the main housing through the dispensing opening.

15. The fabric towel dispenser, as recited in claim 14, wherein the driving assembly further comprises a towel driving motor mounted in the main housing and operatively connected to the used towel supporting shaft for driving the used towel supporting shaft to rotate for retracting the used towel sheet thereon.

16. The fabric towel dispenser, as recited in claim 15, wherein the supporting panel of the towel replacement arrangement is supported in the receiving compartment at the lower portion of the main housing and positioned corresponding to the used towel supporting shaft, wherein when the supporting panel is in the locking position, the supporting panel is capable of being upwardly and pivotally flipped to connect to and reinforce the used towel supporting shaft, wherein when the supporting panel is in the releasing position, the supporting panel is capable of being downwardly and pivotally flipped to allow the used towel supporting shaft and the roll of the used towel sheet to be taken out from the receiving compartment.

17. The fabric towel dispenser, as recited in claim 16, further comprising a reinforcing member and an unused towel supporting shaft mounted on the upper portion of the main housing in the receiving compartment, the unused towel supporting shaft being arranged to support the unused towel sheet at the upper portion of the main housing, the reinforcing member being arranged to pivotally mount on the upper portion of the main housing in such a manner that the reinforcing member is capable of being pivotally and downwardly moved to lock up a position of the unused towel supporting shaft, and pivotally and upwardly moved to unblock a moving path thereof.

18. The fabric towel dispenser, as recited in claim 15, further comprising a reinforcing member and an unused towel supporting shaft mounted on the upper portion of the main housing in the receiving compartment, wherein the reinforcing member is deformable and movable, so as to allow extra space for the used towel supporting shaft to be taken out from the receiving compartment.

19. A fabric towel dispenser mounted on a wall surface, comprising:

a main housing mounted on the wall surface and having a receiving compartment, and a dispensing opening which is substantially vertical to the wall surface communicating with the receiving compartment, the receiving compartment being adapted for receiving a roll of unused towel sheet which is substantially vertical to the wall surface, the main housing having an upper portion and a lower portion, wherein the used towel supporting shaft is in the receiving compartment;

a used towel supporting shaft extending perpendicular to the wall surface and being horizontally supported in the receiving compartment of the main housing for supporting a roll of used towel sheet;

a dispensing roller mounted in the lower portion of the main housing at a position adjacent to the dispensing opening for driving the unused towel sheet to be dispensed out of the dispensing opening;

a driving assembly mounted in the receiving compartment and connected to the used towel supporting shaft and the dispensing roller for sequentially driving the unused towel sheet to pass through the dispensing opening for dispensing, and to drive the used towel sheet to be retracted and collected by the used towel supporting shaft, the driving assembly comprising a dispensing motor mounted in the receiving compartment and operatively connected to the dispensing roller for driving the dispensing roller to rotate so as to drive the unused towel sheet to be dispensed out of the main housing through the dispensing opening, and a towel driving motor mounted in the main housing and operatively connected to the used towel supporting shaft for driving the used towel supporting shaft to rotate for retracting used towel sheet thereon;

a plurality of guiding members mounted in the receiving compartment for guiding the roll of unused towel sheet to sequentially pass through the dispensing opening and collected by the used towel supporting shaft; and a partitioning member is provided in the receiving compartment to separate the unused towel sheet and used towel sheet;

a towel replacement arrangement which comprises a supporting panel which is supported in the receiving compartment, and connected to the used towel supporting shaft, in such a manner that the supporting panel is capable of operating between a locking mode and a releasing mode, wherein in the locking mode, the supporting panel is securely connected to the used towel supporting shaft to lock up a position of the used towel supporting shaft in the receiving compartment, wherein in the releasing mode, the supporting panel is arranged to unlock the used towel supporting shaft for facilitating disposal of the used towel sheet, wherein the supporting panel has a through hole and is securely and immovably mounted in the main housing at a position corresponding to the used towel supporting shaft, wherein when the supporting panel is in the locking mode, the used towel supporting shaft is inserted through the through hole and connected to the driving motor and is locked to the supporting panel at the through hole so that the used towel supporting shaft is securely retained and reinforced in the receiving compartment, wherein when the supporting panel is in the releasing mode, the used towel supporting shaft is unlocked from the supporting panel so that the used towel supporting shaft is capable of being taken out from the through hole, so that the used towel sheet is released from the used towel supporting shaft and is capable of being taken out from the main housing.

* * * * *